US007476303B2

(12) United States Patent
Yasuda et al.

(10) Patent No.: US 7,476,303 B2
(45) Date of Patent: Jan. 13, 2009

(54) ELECTROLYTIC PROCESSING APPARATUS AND ELECTROLYTIC PROCESSING METHOD

(75) Inventors: Hozumi Yasuda, Tokyo (JP); Ikutaro Noji, Tokyo (JP); Kazuto Hirokawa, Tokyo (JP); Takeshi Iizumi, Tokyo (JP); Itsuki Kobata, Tokyo (JP)

(73) Assignee: Ebara Corporation, Tokyo (JP)

( * ) Notice: Subject to any disclaimer, the term of this patent is extended or adjusted under 35 U.S.C. 154(b) by 635 days.

(21) Appl. No.: 10/914,190

(22) Filed: Aug. 10, 2004

(65) Prior Publication Data

US 2005/0035001 A1 Feb. 17, 2005

(30) Foreign Application Priority Data

Aug. 11, 2003 (JP) ..... 2003-207200
Oct. 8, 2003 (JP) ..... 2003-349376

(51) Int. Cl.
*C25F 3/16* (2006.01)
*B23H 5/06* (2006.01)
*B23H 5/10* (2006.01)
*B23H 5/14* (2006.01)

(52) U.S. Cl. ..... 204/224 M; 204/242

(58) Field of Classification Search ..... None
See application file for complete search history.

(56) References Cited

U.S. PATENT DOCUMENTS 6,722,950 B1 4/2004 Dabral et al.
2004/0112761 A1 6/2004 Saito et al.
2005/0051432 A1 3/2005 Shirakashi et al.

FOREIGN PATENT DOCUMENTS

| | | |
|---|---|---|
| JP | 2001-064799 | 3/2001 |
| JP | 2003-164768 | 6/2003 |
| JP | 2003-175422 | 6/2003 |
| JP | 2003-225831 | 8/2003 |
| WO | WO 02/103771 A1 * | 12/2002 |
| WO | WO 03/046263 A1 * | 6/2003 |

* cited by examiner

*Primary Examiner*—Harry D Wilkins, III
(74) *Attorney, Agent, or Firm*—Wenderoth, Lind & Ponack, L.L.P.

(57) ABSTRACT

There are provided an electrolytic processing apparatus and an electrolytic processing method which can regenerate an ion exchanger with an enhanced regeneration rate of ion-exchange capacity without adversely affecting the throughput of the apparatus. The electrolytic processing apparatus includes: a holder for holding a workpiece; an electrode section including an electrode, a contact member, and a discharge portion for discharging metal ions which have been taken from the workpiece into the contact member during processing, said electrode section coming close to or into contact with the workpiece held by the holder to effect processing of the workpiece in the presence of a liquid; and a regeneration dummy electrode which can come close to or into contact with the contact member.

14 Claims, 24 Drawing Sheets

ELECTROLYTIC PROCESSING APPARATUS AND ELECTROLYTIC PROCESSING METHOD

BACKGROUND OF THE INVENTION

1. Field of the Invention

The present invention relates to an electrolytic processing apparatus and an electrolytic processing method, and more particularly to an electrolytic processing apparatus and an electrolytic processing method useful for processing a conductive material formed in a surface of a substrate, such as a semiconductor wafer, or for removing impurities adhering to a surface of a substrate.

2. Description of the Related Art

In recent years, instead of using aluminum or aluminum alloys as a material for forming circuits on a substrate such as a semiconductor wafer, there is an eminent movement towards using copper (Cu) which has a low electric resistivity and high electromigration resistance. Copper interconnects are generally formed by filling copper into fine recesses formed in a surface of a substrate. Various techniques for forming such copper interconnects are known including chemical vapor deposition (CVD), sputtering, and plating. According to any such technique, a copper film is formed in a substantially entire surface of a substrate, followed by removal of unnecessary copper by chemical mechanical polishing (CMP).

FIGS. 1A through 1C illustrate, in sequence of process steps, an example of forming such a substrate W having copper interconnects. As shown in FIG. 1A, an insulating film 2, such as an oxide film of $SiO_2$ or a film of low-k material, is deposited on a conductive layer 1*a* in which semiconductor devices are formed, which is formed on a semiconductor base 1. Contact holes 3 and interconnect trenches 4 are formed in the insulating film 2 by a lithography/etching technique. Thereafter, a barrier layer 5 of TaN or the like is formed on the insulating film 2, and a seed layer 7 as an electric supply layer for electroplating is formed on the barrier layer 5 by sputtering or CVD, or the like.

Then, as shown in FIG. 1B, copper plating is performed on the surface of the substrate W to fill the contact holes 3 and the interconnect trenches 4 with copper and, at the same time, deposit a copper film 6 on the insulating film 2. Thereafter, the copper film 6, the seed layer 7 and the barrier layer 5 on the insulating film 2 are removed by chemical mechanical polishing (CMP) or the like so as to make the surface of the copper film 6 filled in the contact holes 3 and the interconnect trenches 4, and the surface of the insulating film 2 lie substantially on the same plane. Interconnects composed of the copper film 6 as shown in FIG. 1C are thus formed.

Components in various types of equipments have recently become finer and have required higher accuracy. As submicro manufacturing technology has commonly been used, the properties of materials are largely influenced by the processing method. Under these circumstances, in a conventional machining method in which a desired portion of a workpiece may be physically destroyed and removed from the surface by a tool, a large number of defects may be produced which deteriorates the properties of the workpiece. Therefore, it becomes important to perform processing without deteriorating the properties of the materials.

Some processing methods, such as chemical polishing, electrolytic processing, and electrolytic polishing, have been developed in order to solve this problem. In contrast with the conventional physical processing, these methods perform removal processing or the like through chemical dissolution reaction. Therefore, these methods do not suffer from defects such as formation of an altered layer and dislocation due to plastic deformation, so that processing can be performed without deteriorating the properties of the materials.

An electrolytic processing method that utilizes an ion exchanger has been developed. As shown in FIG. 2, an ion exchanger 12*a* mounted on a processing electrode 14 and an ion exchanger 12*b* mounted on a feeding electrode 16 are allowed to be close to or into contact with the surface of a workpiece 10. A voltage is applied from a power source 17 to between the processing electrode 14 and the feeding electrode 16 while a processing liquid 18, such as ultrapure water, is supplied from a fluid supply section 19 to between the processing electrode 14, feeding electrode 16 and the workpiece 10, thereby carrying out removal processing of the surface layer of the workpiece 10. According to this electrolytic processing, water molecules 20 in the processing liquid 18, such as ultrapure water, are dissociated by the ion exchangers 12*a* and 12*b* into hydroxide ions 22 and hydrogen ions 24. The hydroxide ions 22 thus produced, for example, are carried, by the electric field between the workpiece 10 and the processing electrode 14 and by the flow of the processing liquid 18, such as ultrapure water, to the surface of the workpiece 10 facing the processing electrode 14, whereby the density of the hydroxide ions 22 in the vicinity of the workpiece 10 is increased, and the hydroxide ions 22 are reacted with the atoms 10*a* of the workpiece 10. The reaction product 26 produced by reaction is dissolved in the processing liquid 18 such as ultrapure water, and removed from the workpiece 10 by the flow of the processing liquid 18 along the surface of the workpiece 10.

When carrying out electrolytic processing of e.g. copper by using as an ion exchanger a cation exchanger having a cation-exchange group, copper is captured by the cation-exchange group. Progress of the consumption of the cation-exchange group by copper makes it impossible to continue the electrolytic processing. When electrolytic processing of copper is carried out by using as an ion exchanger an anion exchanger having an anion-exchange group, on the other hand, fine particles of a copper oxide are produced and the particles adhere to the surface of the ion exchanger (anion exchanger), whereby particles may harm the uniformity of the processing rate.

Such harmful effects can be eliminated by regenerating the ion exchanger. Regeneration of an ion exchanger is effected by exchange of an ion captured by the ion exchanger for a hydrogen ion in the case of a cation exchanger, and for a hydroxide ion in the case of an anion exchanger.

Regeneration of an ion exchanger is generally carried out by immersing the ion exchanger in an acid solution in the case of a cation exchanger, and in an alkali solution in the case of an anion exchanger. With a cation exchanger which has captured an ion having an ion selectivity coefficient close to that of a hydrogen ion, such as a sodium ion, for example, the ion exchanger can be regenerated in a very short time by immersing it in an acid. When an ion exchanger which has captured an ion having a large ion selectivity coefficient is regenerated with an acid solution or an alkali solution, however, the generation speed is very slow. Further, a chemical remains in a high concentration in the regenerated ion exchanger, which necessitates cleaning of the ion exchanger. Further, it is necessary to separately provide a regeneration tank for storing a regeneration liquid which may occupy a considerable installation area. In addition, processing must be stopped for regeneration of an ion exchanger, leading to lowering of the throughput.

An ion exchanger to be in contact with a workpiece, from the viewpoint of a smooth surface, is in the form of, for example, a thin film. Accordingly, the ion-exchange capacity, which is an index of the ion accumulation capacity, is generally small. It is, therefore, a common practice to interpose an ion exchanger having a large ion-exchange capacity between an ion exchange in a film form and an electrode so that most of processing products may be taken in the interposed portion (interposed ion exchanger). After carrying out processing for some length of time, however, the interposed portion does not take processing products anymore, and therefore must be changed for a new one or regenerated. The change of the ion exchanger takes a considerable time during which processing must be stopped. The regeneration also necessitates a stop of processing, which adversely affects the throughput of the apparatus.

In view of this, it may be considered to discharge metal ions, etc., which have been removed from a workpiece and taken in an ion exchanger, to a discharge section (out of the system) during processing by using, for example, an electrodialysis regeneration method, thereby regenerating the ion exchanger during processing. In such an in-process regeneration method, however, metal ions, etc., which have newly dissolved out of the workpiece, are constantly taken into the ion exchanger during regeneration. Thus, depending upon the conditions, all the metal ions taken into the ion exchanger could not be fully discharged out of the system.

SUMMARY OF THE INVENTION

The present invention has been made in view of the above situation in the related art. It is therefore a first object of the present invention to provide an electrolytic processing apparatus and an electrolytic processing method which can regenerate an ion exchanger with an enhanced regeneration rate of ion-exchange capacity without adversely affecting the throughput of the apparatus.

It is a second object of the present invention to provide an electrolytic processing apparatus and an electrolytic processing method which can regenerate a contact member composed of, for example, an ion exchanger easily and quickly without adversely affecting the throughput of the apparatus.

In order to achieve the above object, the present invention provides an electrolytic processing apparatus comprising: a holder for holding a workpiece; an electrode section including an electrode, a contact member, and a discharge portion for discharging metal ions which have been taken from the workpiece into the contact member during processing, said electrode section coming close to or into contact with the workpiece held by the holder to effect processing of the workpiece in the presence of a liquid; and a regeneration dummy electrode which can come close to or into contact with the contact member.

By bringing the regeneration dummy electrode into contact with the contact member and operating as if carrying out electrolytic processing of the regeneration dummy electrode, regeneration of the contact member utilizing the discharge portion provided in the electrode section can be effected. Since the regeneration dummy electrode is not in fact processed electrolytically, there is no dissolution of metal ions, etc. from the regeneration dummy electrode and, therefore, no taking-in of metal ions, etc. by the contact member.

According to this electrolytic processing apparatus, regeneration of the contact member can be carried out by discharging, during processing, metal ions, which have been taken from a workpiece into the contact member during processing, from the discharge portion. This can prevent the regeneration from adversely affecting the throughput of the apparatus. Further, regeneration of the contact member may also be carried out by bringing the regeneration dummy electrode into contact with the contact member in the non-processing state, i.e. the state without taking-in of new metal ions, etc., and discharging metal ions in the contact member from the discharge portion. This makes it possible to regenerate the contact member with an enhanced regeneration rate of accumulation capacity.

Upon contact of the regeneration dummy electrode with the contact member, metal ions are discharged from that portion of the contact member which is not in contact with the workpiece, i.e. that portion of the contact member which is not in use for processing. By the expression "that portion of the contact member which is not in use for processing" herein is meant (1) the portion which has been released from contact (closeness) with a workpiece during relative movement with the workpiece and is not participating in processing, or (2) the portion which is released from contact (closeness) with a workpiece after completion of processing or in an interval between processings.

It is preferred that the regeneration dummy electrode have a shape conforming to the shape of the electrode section including electrodes (processing electrode and feeding electrode) and have a larger size than the area of the contact member for use in the processing of a workpiece. It is possible to move the regeneration dummy electrode and the contact member relative to each other during regeneration so that the entire surface of the contact member for use in processing may be regenerated.

The contact member is preferably composed of anion exchanger or a pad, or a combination thereof.

The use of an ion exchanger as the contact member enables effective regeneration thereof. Examples of a contact member other than an ion exchanger include liquid-permeable scrubbing members, such as a non-woven fabric, a foamed polyurethane, a PVA sponge, a polyurethane sponge, etc. It is also possible to make the contact member liquid-permeable by forming holes in it.

A voltage may be applied between the regeneration dummy electrode and an electrode of the electrode section.

Regeneration of the contact member utilizing the discharge portion provided in the electrode section may also be carried out by applying a voltage between the regeneration dummy electrode and the electrode of the electrode section.

Ultrapure water, pure water or a liquid having an electrolytic conductivity of not more than 500 μS/cm may be supplied between the contact member and the regeneration dummy electrode.

Ultrapure water is, for example, a water having an electric conductivity (referring herein to that at 25° C., 1 atm) of not more than 0.1 μS/cm. Pure water is generally a water having an. The use of pure water, preferably ultrapure water (for example, electric conductivity of not more than 10 μS/cm) in electrolytic processing enables a clean processing without leaving impurities on the processed surface of a workpiece, whereby a cleaning step after the electrolytic processing can be simplified. It is also possible to use a liquid obtained by adding an additive, such as a surfactant, to pure water or ultrapure water, and having an electric conductivity of not more than 500 μS/cm, preferably not more than 50 μS/cm, more preferably not more than 0.1 μS/cm. The local concentration of reactant ions can be prevented by allowing the additive, which plays a role to prevent local concentration of ions, to exist between a workpiece and an ion exchanger.

The supply of the liquid between the contact member and the regeneration dummy electrode may be carried out by (1)

dropping onto the processing surface of the contact member, (2) supply from the surface of the regeneration dummy electrode, (3) supply from a supply port provided beside the electrode or (4) supply from a supply port of the electrode, or a combination thereof.

It is preferred that at least that portion of the regeneration dummy electrode which comes close to or into contact with the contact member be made of a chemically or electrochemically inactive conductive material.

The chemically or electrochemically inactive conductive material may be exemplified by platinum and iridium. The regeneration dummy electrode may be produced, for example, by plating or coating platinum or iridium onto a titanium electrode base. The plated or coated electrode may be subjected to sintering at a high temperature to stabilize and strengthen the electrode.

Preferably, the electrolytic processing apparatus further comprises a mechanism for bringing the regeneration dummy electrode close to or into contact with the contact member for regeneration of the contact member, and the processing of the workpiece, held by the holder, by the electrode section and the regeneration of the contact member by the regeneration dummy electrode are carried out separately.

By carrying out the regeneration of the contact member by the regeneration dummy electrode and the processing of the workpiece by the electrode section separately, it becomes possible to control the respective operations separately and carry out the operations under the optimum conditions.

To carry out the regeneration of the contact member and the processing by the electrode member "separately" includes the cases of (1) controlling the electrode section and the regeneration dummy electrode separately and the case of (2) carrying out the processing and the regeneration at separate times, for example, carrying out the regeneration after processing or in an interval between processings.

The regeneration of the contact member by the regeneration dummy electrode may be carried out simultaneously with the processing of the workpiece, held by the holder, by the electrode section.

By bringing the regeneration dummy electrode close to or into contact with the contact member to regenerate the contact member, which is not in use for processing, simultaneously with processing of the workpiece, held by the holder, by the electrode section, it becomes possible to further enhance the throughput of the apparatus.

The regeneration dummy electrode may be disposed such that it surrounds the workpiece, and may move together with the holder.

This can avoid the necessity for a mechanism for moving the regeneration dummy electrode and can thus simplify the apparatus.

Preferably, the electrolytic processing apparatus further comprises a contact pressure control section for controlling the contact pressure of the regeneration dummy electrode on the contact member.

When the pressure of the regeneration dummy electrode on the contact member is made higher than the pressure of the workpiece on the contact member, for example, the distance between the regeneration dummy electrode and the electrode section becomes smaller and the resistance between them becomes smaller, whereby the electric current that flows between them increases and therefore the regeneration efficiency increases. In this case, however, the frictional force between the regeneration dummy electrode and the contact member generated upon their relative movement becomes larger, whereby the contact member is more likely to wear. When the pressure of the regeneration dummy electrode on the contact member is made lower than the pressure of the workpiece on the contact member, on the other hand, though the frictional force between them becomes smaller, the resistance becomes larger and therefore the regeneration efficiency decreases. It is thus preferred to control the pressure of the regeneration dummy electrode such that regeneration can be effected with a low power consumption and with the smallest possible wear of the contact member.

The contact pressure control section may control the contact pressure by its own weight or by an actuator or the pressure of a fluid introduced into a pressure chamber.

The present invention also provides another electrolytic processing apparatus comprising: an ion discharge mechanism for discharging metal ions, which have been taken into a contact member in contact with a workpiece during electrolytic processing, out of the contact member, said ion discharge mechanism including; a first ion discharge mechanism for discharging the metal ions in the contact member from that portion of the contact member which is in contact with the workpiece, and a second ion discharge mechanism for discharging the metal ions in the contact member from that portion of the contact member which is not in contact with the workpiece.

The present invention also provides an electrolytic processing method comprising: bringing a contact member of an electrode section into contact with a workpiece to effect processing of the workpiece while discharging metal ions, which have been taken into the contact member, to a discharge portion provided within the electrode section during the processing; and bringing a regeneration dummy electrode into contact with the contact member to discharge metal ions in the contact member to the discharge portion.

Preferably, the discharge of metal ions in the contact member to the discharge portion during the processing of the workpiece is carried out separately from the discharge of metal ions to the discharge portion by the contact of the regeneration dummy electrode with the contact member.

The discharge of metal ions in the contact member to the discharge portion during the processing of the workpiece may be carried out simultaneously with the discharge of metal ions to the discharge portion by the contact of the regeneration dummy electrode with the contact member.

The present invention also provides another electrolytic processing method comprising: processing a workpiece by bringing a contact member into contact with the workpiece while discharging metal ions, which have been taken into that portion of the contact member which is in contact with the workpiece, out of the contact member by a first ion discharge mechanism; and discharging metal ions, which have been taken into that portion of the contact member which is not in contact with the workpiece, out of the contact member by a second ion discharge mechanism.

The present invention also provides yet another electrolytic processing apparatus comprising: a substrate holder for holding a substrate; a feeding electrode for feeding electricity to the substrate; a processing table provided with a processing electrode; a contact member, positioned between the substrate held by the substrate holder and the processing table, which comes into contact with the substrate upon processing; a power source for applying a voltage between the processing electrode and the feeding electrode; a regeneration section disposed opposite the contact member not facing the substrate holder; and a regeneration power source to be connected to the regeneration section; wherein the regeneration section is brought into contact with the contact member on the processing table to regenerate the contact member during processing.

According to this electrolytic processing apparatus, a voltage is applied between the processing electrode and the feeding electrode to carry out processing of the substrate with the processing electrode while feeding electricity to the substrate with the feeding electrode, while the regeneration section is brought into contact with the contact member on the processing table to regenerate the contact member. In this manner, processing of the substrate utilizing the contact member on the processing table and regeneration of the contact member can be carried out simultaneously.

In a preferred embodiment of the present invention, the regeneration section includes a regeneration member for contact with the contact member, and a regeneration electrode disposed on the opposite side of the regeneration member from the processing electrode and/or the feeding electrode and having a lower electric potential than the processing electrode.

According to this embodiment, a voltage may be applied by, for example, connecting the processing electrode and/or the feeding electrode to the anode of the power source and connecting the regeneration electrode to the cathode while allowing the contact member to be in contact with the processing electrode and/or the feeding electrode. During the electrolytic processing, impurity ions, such as copper ions, which have been taken into the contact member, are moved toward the regeneration member so that the impurity ions can be discharged from the contact member and taken into the regeneration member.

The regeneration section preferably includes a discharging liquid flow passage formed between the regeneration member and the regeneration electrode.

The impurity ions, coming from the contact member, can be passed through the regeneration member and introduced into the discharging liquid flow passage, and the ions can then be discharged out of the system with a discharging liquid flowing along the discharging liquid flow passage.

In a preferred embodiment of the present invention, the regeneration section includes a regeneration member for contact with the contact member, and a regeneration electrode disposed on the opposite side of the regeneration member from the processing electrode and/or the feeding electrode and having a higher electric potential than the processing electrode, and a discharging liquid flow passage is provided in the interior of the processing table.

According to this embodiment, a voltage may be applied by, for example, connecting the processing electrode to the cathode of the power source and connecting the regeneration electrode, and optionally the feeding electrode, to the anode while allowing the contact member to be in contact with the processing electrode and/or the feeding electrode. By thus operating as if carrying out electrolytic processing of the contact member, impurity ions such as copper ions, taken into the contact member, can be moved in a direction away from the regeneration electrode and introduced into the discharging liquid flow passage provided within the processing table, and can be discharged out of the system with a discharging liquid flowing along the discharging liquid flow passage.

Preferably, the regeneration section moves in conjunction with the movement of the substrate holder or the contact member, or moves independently.

When the contact member moves, for example, the regeneration section may move in such a manner as not to cause relative movement between the contact member and the regeneration member. This can prevent the contact member and the regeneration member, which may be ion exchangers generally having poor wear resistance, from wearing by rubbing.

Alternatively, the regeneration section may remain stationary while the substrate holder or the contact member is moving.

The present invention also provides yet another electrolytic processing apparatus comprising: a processing electrode; a feeding electrode for feeding electricity to a substrate; a substrate holder for holding the substrate; a contact member which comes into contact with the substrate upon processing; a power source for applying a voltage between the processing electrode and the feeding electrode when the contact member is in contact with the substrate to effect processing of the surface of the substrate; and a regeneration section including a regeneration member which comes into contact with the contact member to effect regeneration of the contact member; wherein the regeneration section is so designed that at least the surface of the regeneration member is movable.

According to this electrolytic processing apparatus, it is possible, for example, to regenerate the contact member in contact with the regeneration member while moving the surface of the regeneration member in such a manner as not to cause relative movement with the contact member. This can prevent the contact member and the regeneration member, which may be ion exchangers generally having poor wear resistance, from wearing by rubbing. The regeneration section may be not connected to a regeneration power source but, as a dummy electrode, may be brought into contact with the contact member to regenerate the contact member.

The regeneration section may be so designed that the regeneration section itself moves to move the surface of the regeneration member.

Alternatively, the regeneration section may be so designed that the regeneration member is circulated or taken up to move the surface of the regeneration member.

Preferably, the regeneration of the contact member is carried out by moving the contact member and the regeneration member substantially in the same direction while allowing them to be in contact with each other.

Alternatively, the regeneration of the contact member may be carried out by moving the contact member and the regeneration member in such a manner as not to cause substantial relative movement there between while allowing them to be in contact with each other.

The contact member is preferably composed of an ion exchanger.

During electrolytic processing of a substrate using an ion exchanger, impurity ions such as copper ions, which have been taken from the substrate into the ion exchanger, can be discharged from the ion exchanger to thereby regenerate the ion exchanger.

The regeneration member is preferably composed of an ion exchanger.

The present invention also provides yet another electrolytic processing method comprising: allowing a substrate and a processing table having a processing electrode to face each other; providing a contact member between the substrate and the processing table, and allowing the contact member to be in contact with the substrate; applying a voltage between the processing electrode and the substrate in the presence of a liquid to process the substrate; and bringing a regeneration member of a regeneration section into contact with the contact member on the processing table while connecting the regeneration section to a regeneration power source to apply voltage between the regeneration section and the processing electrode, thereby regenerating the contact member.

The present invention also provides yet another electrolytic processing method comprising: allowing a substrate and a processing electrode to face each other; providing a contact member between the substrate and the processing electrode, and allowing the contact member to be in contact with the substrate; applying a voltage between the processing electrode and the substrate in the presence of a liquid to process the substrate; and bringing a regeneration member of a regeneration section into contact with the contact member while moving at least the surface of the regeneration member, thereby regenerating the contact member.

The regeneration section itself may move in order to move the surface of the regeneration member.

The regeneration member may be circulated or taken up to move the surface of the regeneration member.

The regeneration of the contact member may be carried out by moving the contact member and the regeneration member substantially in the same direction while allowing them to be in contact with each other.

The regeneration of the contact member may be carried out by moving the contact member and the regeneration member in such a manner as to not cause substantial relative movement there between while allowing them to be in contact with each other.

The above and other objects, features, and advantages of the present invention will be apparent from the following description when taken in conjunction with the accompanying drawings which illustrate preferred embodiments of the present invention by way of example.

DETAILED DESCRIPTION OF THE PREFERRED EMBODIMENTS

Preferred embodiments of the present invention will now be described in detail with reference to the drawings. The following description illustrates the case of using a substrate as a workpiece and employing an electrolytic processing apparatus (electrolytic polishing apparatus) adapted to remove (polish) a copper film 6 (see FIG. 1B) deposited on the substrate. The present invention, however, is of course applicable to a workpiece other than a substrate and to other electrolytic processings.

Figure 3:
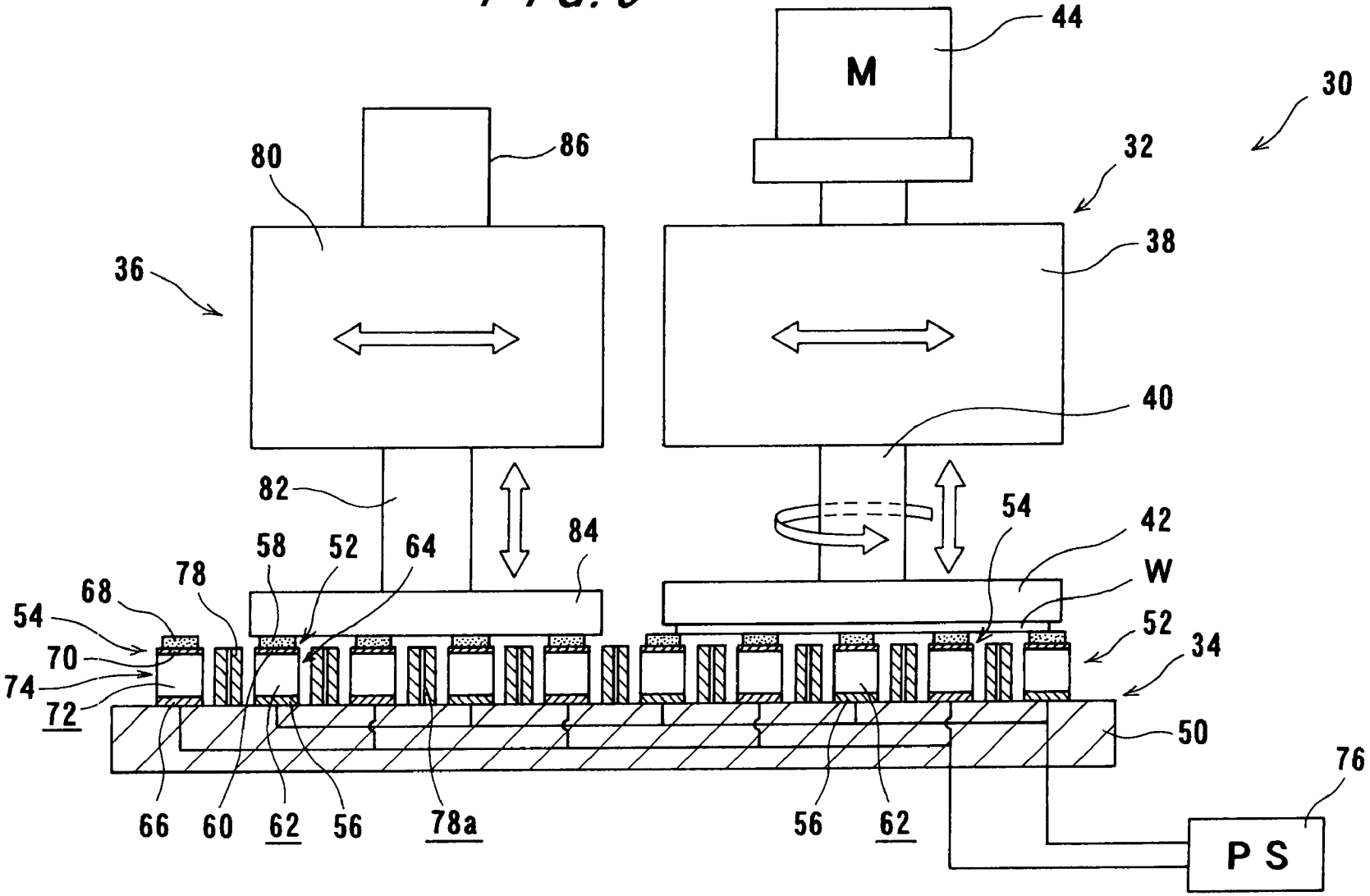
FIG. 3 is a vertical sectional front view of an electrolytic processing apparatus according to an embodiment of the present invention.
Figure 4:
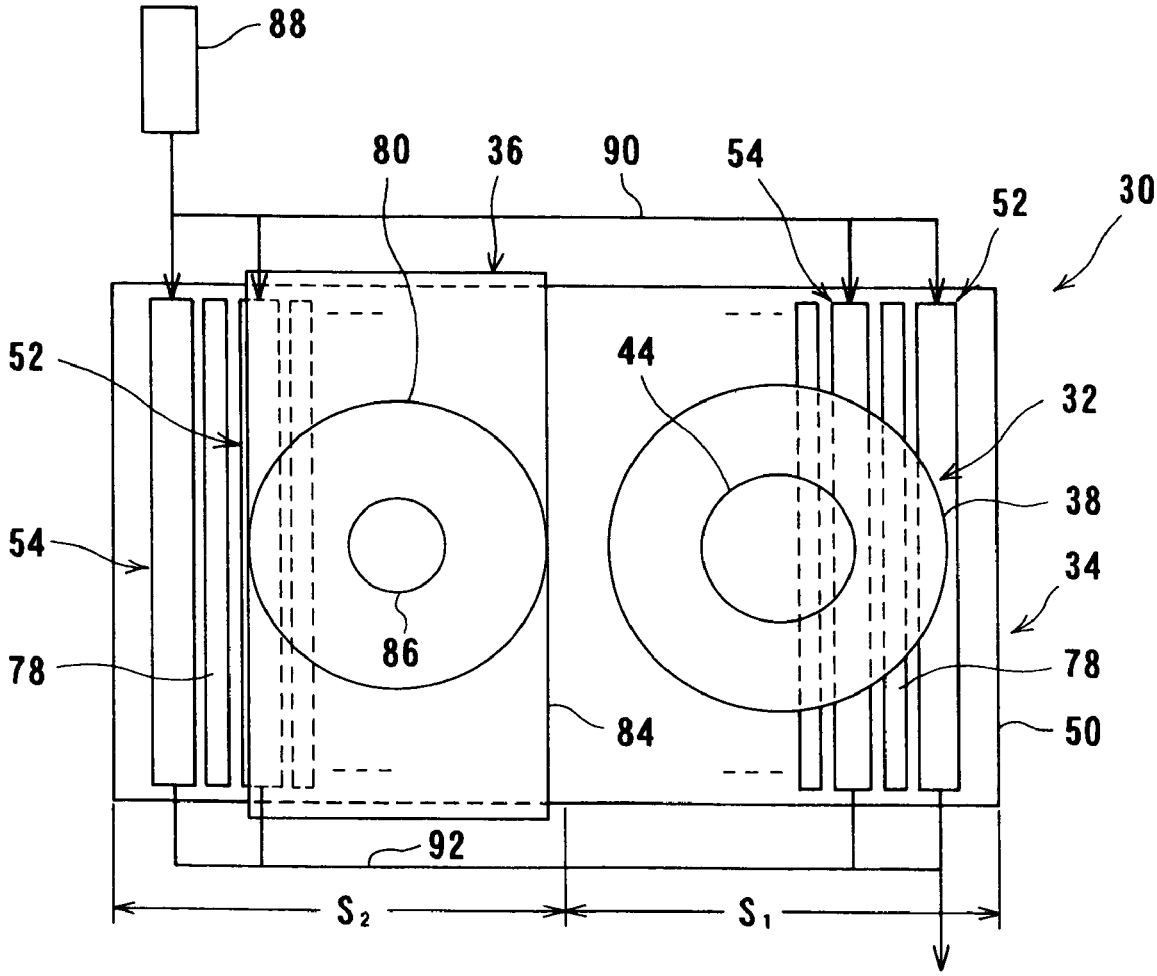
FIG. 4 is a plan view of the electrolytic processing apparatus of FIG. 3.

FIG. 3 is a vertical sectional front view of an electrolytic processing apparatus 30 according to an embodiment of the present invention, and FIG. 4 is a plan view of the electrolytic processing apparatus 30. As shown in FIGS. 3 and 4, the electrolytic processing apparatus 30 is mainly comprised of a substrate holding section 32 for detachably holding a substrate W, such as a semiconductor wafer, as a workpiece, an electrode section 34 including a plurality of electrode members (processing electrode members and feeding electrode members), and a regeneration dummy electrode holding section 36 disposed adjacent to the electrode section 34.

The substrate holding section 32 includes a substrate holding head 38 which is movable horizontally in the lateral direction perpendicular to the below-described electrode members 52, 54, a main shaft 40, penetrating through the substrate holding head 38 and extending vertically, which is rotatable and vertically movable, and a substrate holder 42, coupled to the lower end of the main shaft 40, for detachably holding a substrate W with its front surface (to-be-processed surface) facing downwardly (facedown). The main shaft 40 is coupled to a rotating motor 44 and rotates by the rotation of the rotating motor 44.

The electrode section 34 includes an electrode base 50 in a rectangular tabular shape. A plurality of long processing electrode members 52 and feeding electrode members 54 are arranged alternately and in parallel at a given pitch on an upper surface of the electrode base 50. Each processing electrode member 52 includes a processing electrode 56 and an ion exchanger 58 as a contact member. A discharge portion 64 comprised of a diaphragm 60 and a discharge passage 62 formed between the diaphragm 60 and the processing electrode 56, constituting an ion discharge mechanism, is provided between the processing electrode 56 and the ion exchanger (contact member) 58. Similarly, each feeding electrode member 54 includes a feeding electrode 66 and an ion exchanger (contact member) 68. A discharge portion 74 comprised of a diaphragm 70 and a discharge passage 72 formed between the diaphragm 70 and the feeding electrode 66, constituting an ion discharge mechanism, is provided between the feeding electrode 66 and the ion exchanger 68. In case no processing product is to be accumulated in the ion exchanger 68 covering the feeding electrode 66, the discharge portion 74 may not be provided.

According to this embodiment, the processing electrodes 56 are to be connected to a cathode of a power source 76, and the feeding electrodes 66 are to be connected to an anode of the power source 76. This applies to processing of e.g. copper, because electrolytic processing of copper proceeds on the cathode side. Depending upon a material to be processed, the cathode side can be a feeding electrode and the anode side can be a processing electrode. Thus, when the material to be processed is copper, molybdenum, iron, or the like, the electrolytic processing action occurs on the cathode side, and therefore the electrode connected to the cathode of the power source becomes a processing electrode, and the electrode connected to the anode becomes a feeding electrode. On the other hand, when the material to be processed is aluminum, silicon, or the like, the electrolytic processing action occurs on the anode side, and therefore the electrode connected to the anode of the power source becomes a processing electrode and the electrode connected to the cathode becomes a feeding electrode.

By thus providing the processing electrodes 56 and the feeding electrodes 66 in parallel and alternately, provision of a feeding section for feeding electricity to the conductive film (to-be-processed material) of the substrate W is no longer necessary, and processing of the entire surface of the substrate becomes possible. Further, by changing the voltage applied between the processing electrodes 56 and the feeding electrodes 66 in a rectangular pulse form of ON and OFF, for example, it becomes possible to dissolve the electrolysis products, and improve the flatness of the processed surface through the multiplicity of repetitions of processing.

With respect to the processing electrodes 56 and the feeding electrodes 66, oxidation or dissolution thereof due to an electrolytic reaction may be a problem. In view of this, as a material for the electrode, it is preferable to use, besides the conventional metals and metal compounds, carbon, relatively inactive noble metals, conductive oxides or conductive ceramics. A noble metal-based electrode may, for example, be one obtained by plating or coating platinum or iridium onto a titanium electrode, and then sintering the coated electrode at a high temperature to stabilize and strengthen the electrode. Ceramic products are generally obtained by heat-treating inorganic raw materials, and ceramics products having various properties are produced from various raw materials including oxides, carbides and nitrides of metals and nonmetals. Among them there are ceramics having an electric conductivity. When an electrode is oxidized, the value of the electric resistance generally increases to cause an increase of applied voltage. However, by protecting the surface of an electrode with a non-oxidative material such as platinum or with a conductive oxide such as an iridium oxide, the decrease of electric conductivity due to oxidation of the base material of an electrode can be prevented.

The ion exchangers 58, 68 may be composed of a non-woven fabric which has an anion-exchange group or a cation-exchange group. A cation exchanger preferably carries a strongly acidic cation-exchange group (sulfonic acid group); however, a cation exchanger carrying a weakly acidic cation-exchange group (carboxyl group) may also be used. Though an anion exchanger preferably carries a strongly basic anion-exchange group (quaternary ammonium group), an anion exchanger carrying a weakly basic anion-exchange group (tertiary or lower amino group) may also be used.

The non-woven fabric carrying a strongly basic anion-exchange group can be prepared by, for example, the following method: A polyolefin non-woven fabric having a fiber diameter of 20-50 μm and a porosity of about 90% is subjected to the so-called radiation graft polymerization, comprising γ-ray irradiation onto the non-woven fabric and the subsequent graft polymerization, thereby introducing graft chains; the graft chains thus introduced are then aminated to introduce quaternary ammonium groups thereinto. The capacity of the ion-exchange groups introduced can be determined by the amount of the graft chains introduced. The graft polymerization may be conducted by the use of a monomer such as acrylic acid, styrene, glycidyl methacrylate, sodium styrenesulfonate or chloromethylstyrene, or the like. The amount of the graft chains can be controlled by adjusting the monomer concentration, the reaction temperature and the reaction time. Thus, the degree of grafting, i.e. the ratio of the weight of the non-woven fabric after graft polymerization to the weight of the non-woven fabric before graft polymerization, can be made 500% at its maximum. Consequently, the capacity of the ion-exchange groups introduced after graft polymerization can be made 5 meq/g at its maximum.

The non-woven fabric carrying a strongly acidic cation-exchange group can be prepared by the following method: As in the case of the non-woven fabric carrying a strongly basic anion-exchange group, a polyolefin non-woven fabric having a fiber diameter of 20-50 μm and a porosity of about 90% is subjected to the so-called radiation graft polymerization comprising γ-ray irradiation onto the non-woven fabric and the subsequent graft polymerization, thereby introducing graft chains; and the graft chains thus introduced are then treated with a heated sulfuric acid to introduce sulfonic acid groups thereinto. If the graft chains are treated with a heated phosphoric acid, phosphate groups can be introduced. The degree of grafting can reach 500% at its maximum, and the capacity of the ion-exchange groups thus introduced after graft polymerization can reach 5 meq/g at its maximum.

The base material of the ion exchangers 58, 68 may be a polyolefin such as polyethylene or polypropylene, or any other organic polymer. Further, besides the form of a non-woven fabric, the ion exchangers may be in the form of a woven fabric, a sheet, a porous material, short fibers, or a net, etc.

When polyethylene or polypropylene is used as the base material, graft polymerization can be effected by first irradiating radioactive rays (γ-rays and electron beam) onto the base material (pre-irradiation) to thereby generate a radical, and then reacting the radical with a monomer, whereby uniform graft chains with few impurities can be obtained. When an organic polymer other than polyolefin is used as the base material, on the other hand, radical polymerization can be effected by impregnating the base material with a monomer and irradiating radioactive rays (γ-rays, electron beam and UV-rays) onto the base material (simultaneous irradiation). Though this method fails to provide uniform graft chains, it is applicable to a wide variety of base materials.

By using a non-woven fabric having an anion-exchange group or a cation-exchange group as the ion exchangers 58, 68, it becomes possible that pure water or ultrapure water, or a liquid such as an electrolytic solution can freely move within the non-woven fabric, and the ion-exchange reaction between ions in the liquid and an ion-exchange group of the ion exchanger can be easily taken place.

When the ion exchangers 58, 68 have only one of anion-exchange groups and cation-exchange groups, a limitation is imposed on electrolytically processable materials and, in addition, impurities are likely to form due to the polarity. In order to solve this problem, the ion exchanger 58, 68 may have such a structure wherein anion-exchangers having an anion-exchange group and cation-exchangers having a cation-exchange group are concentrically disposed to constitute an integral structure. The anion exchangers having an anion-exchange group and the cation exchangers having a cation-exchange group may be superimposed. It may also be possible to make the anion-exchangers and the cation-exchangers each in the shape of a fan, and dispose them alternately. Alternatively, the ion exchanger 58, 68 may carry both an anion-exchange group and a cation-exchange group per se. Such an ion exchanger may include an amphoteric ion exchanger in which anion-exchange groups and cation-exchange groups are distributed randomly, a bipolar ion exchanger in which anion-exchange groups and cation-exchange groups are present in layers, and a mosaic ion exchanger in which portions containing anion-exchange groups and portions containing cation-exchange groups are present in parallel in the thickness direction. Incidentally, it is of course possible to selectively use, as the ion exchange 58, 68, one having an anion-exchange group or one having a cation-exchange group according to the material to be processed.

Though in this embodiment the ion exchangers 58, 68 are used as contact members, it is also possible to use, for example, a pad of a liquid-permeable non-woven fabric or a porous sponge instead of the ion exchangers 58, 68. Further, a contact member may be made liquid-permeable by forming holes in it. This holds also for the below-described embodiments.

A flow passage (not shown), connected to a pure water supply source, is formed in the interior of the electrode base 50 of the electrode section 34. Between each processing electrode member 52 and each feeding electrode member 54 is provided a pure water nozzle 78 having inside vertically-extending through-holes 78*a* which communicate with the flow passage. Pure water, preferably ultrapure water, is thus supplied through the through-holes 78*a* to between the substrate W and the ion exchangers 56, 68, and between the below-described regeneration dummy electrode 84 and the ion exchangers 58, 68. The height of the pure water supply nozzle 78 is set to be lower than the electrode members 52, 54 so as to avoid contact of the pure water supply nozzle 78 with the substrate W upon electrolytic processing (regeneration). It is also possible to mount a buffer member, formed of a material having such an elasticity as not to scratch the surface of the substrate W, on the upper surface of the pure water supply nozzle 78. Pads, such as POLYTEX pad (trademark of Rodel, Inc.), a non-woven fabric, a foamed polyurethane, a PVD sponge and a polyurethane sponge, may be used as the buffer member.

Pure water herein refers to water having an electric conductivity of, for example, not more than 10 μS/cm, and ultrapure refers to water having an electric conductivity of, for example, not more than 0.1 μS/cm. Instead of pure water, a liquid having an electric conductivity of not more than 500 μS/cm or an electrolytic solution may be employed. By supplying such a processing liquid during processing, processing products and dissolved gases, which would make the processing unstable, can be removed, enabling uniform and highly reproducible processing.

The regeneration dummy electrode holding section 36 includes a regeneration electrode head 80 which is movable horizontally in the direction perpendicular to the electrode members 52, 54, a vertically-movable lifting shaft 82 extending downwardly from the regeneration electrode head 80, and a rectangular regeneration dummy electrode 84 coupled to the lower end of the lifting shaft 82. The lifting shaft 82 is coupled to a cylinder 86 as a contact pressure control section, which is mounted to the regeneration electrode head 80. The regeneration surface (lower surface), facing the ion exchangers 58, 68, of the regeneration dummy electrode 84 is made of an electrically inactive metal material, for example, platinum or iridium, so that it may not be dissolved in a processing liquid by electrolytic reaction. The regeneration dummy electrode 84 may be produced, for example, by plating or coating platinum or iridium onto a surface of a titanium electrode base, followed by sintering at a high temperature to stabilize and strengthen the electrode.

Though in this embodiment the entire regeneration surface of the regeneration dummy electrode 84 is covered with an electrically inactive material, it is also possible to cover only the region, which comes close to or into contact with the substrate W as a workpiece, with an electrically inactive material.

The length of the regeneration dummy electrode 84 along the length direction of the electrode members 52, 54 is set to be longer than the length of the ion exchangers 58, 68, which make contact with the substrate W held by the substrate holder 42 to effect electrolytic processing of the substrate, of the electrode members 52, 54, so that by moving the regeneration dummy electrode 84 horizontally in the lateral direction, the entire surface of the ion exchangers 58, 68 for use in processing can be regenerated. It is also possible to use a regeneration dummy electrode having a shape conforming to the shape of an electrode section including electrodes (processing electrodes and feeding electrodes) and having a larger area than the area of the ion exchangers for use in processing so that the entire surfaces of the ion exchangers for use in processing can be regenerated without moving the regeneration dummy electrode horizontally in the lateral direction.

The regeneration dummy electrode 84 is used to regenerate the ion exchangers 58, 68 when it is brought close to or into contact with the ion exchangers 58, 68, as described in more detail below. With the provision of the cylinder 86 as a contact pressure control section for controlling the contact pressure of the regeneration dummy electrode 84 on the ion exchangers 58, 68, the pressure of the regeneration dummy electrode 84 on the ion exchangers 58, 68 is, for example, set to be higher than the pressure of the substrate W on the ion exchangers 58, 68 during electrolytic processing, so that the distance between the regeneration dummy electrode 84 and the electrodes 56, 66 during regeneration can be made smaller and therefore the voltage between them can be made higher. In this case, the regeneration dummy electrode 84 and the ion exchangers 58, 68 may be not moved relative to each other, or moved at a slow relative speed so as to prevent the ions exchangers 58, 68 from wearing.

When carrying out electrolytic processing of copper by using, for example, a cation exchanger having cation-exchange groups as the ion exchanger 58 of the processing electrode members 52, most of the ion-exchange groups of the ion exchanger (cation exchanger) 58 are occupied by copper after processing, which lowers the processing efficiency of the next processing. When carrying out electrolytic processing of copper by using as the ion exchanger 58 an anion exchanger having anion-exchange groups, on the other hand, fine particles of copper oxide are generated and the particles adhere to the surface of the ion exchanger (anion exchanger) 58. Such particles on the ion exchanger can contaminate the surface of the next substrate to be processed. According to this embodiment, a cation exchanger is used as the ion exchanger 58, and the ion exchanger 58, which has been in contact with the substrate W and used for processing, is regenerated by the discharge portion 64 during processing.

Similarly, an anion exchanger is used as the ion exchanger 68 of the feeding electrode members 54, and the ion exchanger 68, which has been in contact with the substrate W and used for processing (feeding of electricity), is regenerated by the discharge portion 74 during processing.

In particular, the discharge passages 62, 72, formed between the electrodes 56, 66 and the diaphragms 60, 70, of the discharge portions 64, 74 are at one end connected to a discharging liquid supply line 90, which extends from a discharging liquid supply section 88, for supplying a discharging liquid for discharging contaminants, and at the other end connected to a discharging liquid discharge line 92, as shown in FIG. 4. Thus, a discharging liquid is supplied into the discharge passages 62, 67 and, after flowing in one direction along the discharge passages 62, 67, is discharged out of the system.

It is desired that the diaphragms 60, 70 not hinder the migration therethrough of impurity ions, etc. removed from the ion exchangers 58, 68 to be regenerated and inhibit permeation therethrough of the discharging liquid (including ions in the liquid), flowing in the discharge passages 62, 72, into the ion exchanger 58, 68 side, as described below. In this regard, ion exchangers permit selective permeation therethrough of cations or anions. A suitable ion exchanger as a diaphragm can be selected. Further, a film-shaped ion exchanger as a diaphragm can prevent intrusion of the discharging liquid, flowing between the diaphragm 60 and the processing electrode 56, and between the diaphragm 70 and the feeding electrode 66, into the ion exchanger 58, 68 side. Thus, a suitably selected film-shaped ion exchanger can meet the above requirements for the diaphragm 60 or 70.

It is desired that the discharging liquid to be supplied into the discharge passages 62, 72 be a liquid which has a high electric conductivity (dielectric constant), for example, not less than 50 μS/cm, and which does not form an insoluble compound through a reaction with ions removed from the ion exchangers 58, 68. In this regard, the discharging liquid is for discharging those ions, which have moved from the ion exchangers 58, 68 to be regenerated and passed through the diaphragms 60, 70, out of the system by the flow of the discharging liquid, as described below. The above discharging liquid having a high electric conductivity (dielectric constant), because of its low electric resistance, can reduce the power consumption in the regeneration portions 64, 74. Further the above discharging liquid, which does not form an insoluble or hardly soluble compound (by-product) through a reaction with the impurity ions, can prevent such insoluble or hardly soluble compound from adhering to the diaphragms 60, 70. A suitable discharging liquid may be selected depending upon the type of the impurity ion to be discharged. For example, when regenerating an ion exchanger which has been used in electrolytic polishing of copper, sulfuric acid with a concentration of 1 wt % or higher may be used.

According to this embodiment, the ion exchangers used as the diaphragms 60, 70, respectively, have the same type of ion-exchange group as the ion exchangers 58, 68 to be regenerated. That is, a cation exchanger is used as the diaphragm 60 on the processing electrode member 52 side, while an anion exchanger is used as the diaphragm 70 on the feeding electrode member 54 side. This allows only ions from the ion exchangers 58, 68 to pass through the diaphragms 60, 70, and can prevent the ions in the discharging liquid flowing in the discharge passages 62, 72 from permeating through the diaphragms 60, 70 into the ion exchanger 58, 68 side.

Next, the mechanism of the regeneration will now be described with reference to FIG. 5.

In the case where the ion exchanger is a cation exchanger, only cations (positive ions) can move or migrate electrically within the cation exchanger. In this embodiment, the processing electrode is made a cathode, and therefore a cation exchanger is used as the ion exchange 58 on the processing electrode member 52 side. In the case where the ion exchanger is an anion exchanger, on the other hand, only anions (negative ions) can move or migrate electrically within the anion exchanger. In this embodiment, the feeding electrode is made an anode, and therefore an anion exchanger is used as the ion exchange 68 on the feeding electrode member 54 side.

When a workpiece, such as a substrate W, is close to or in contact with the ion exchanger (cation exchanger) 58 and ion exchanger (anion exchanger) 68, the discharging liquid A for discharging contaminants is supplied from the discharging liquid supply section 88 to the discharge portion 62, 72, and a processing liquid B, such as pure water, for electrolytic processing is supplied from the pure water supply nozzle 78 (see FIG. 3) to between the substrate W and the ion exchangers 58, 68, while a voltage is applied from the power source 76 between the processing electrode 56 as a cathode and the feeding electrode 66 as an anode, thereby carrying out electrolytic processing.

Figure 5:
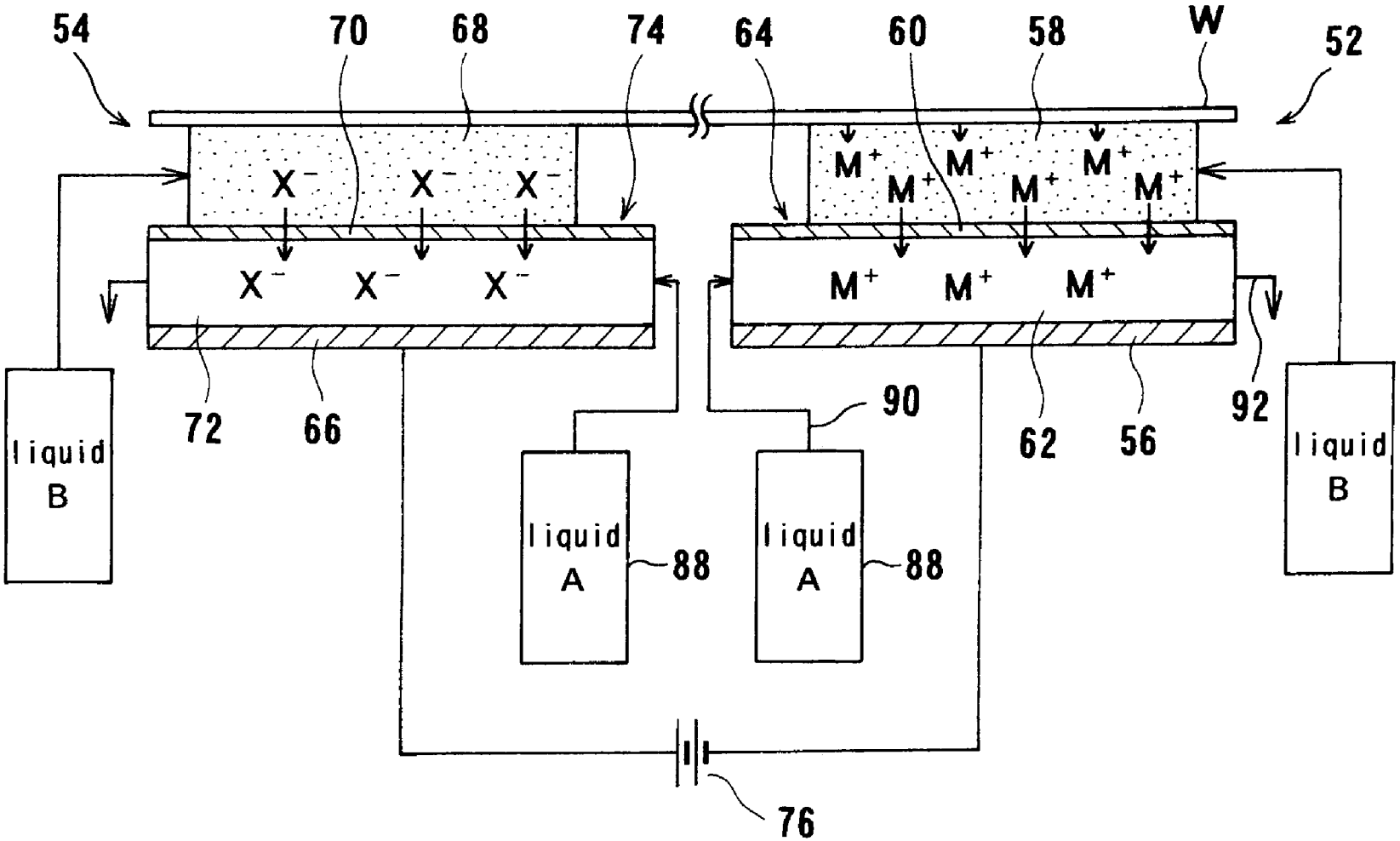
FIG. 5 is a diagram illustrating the principle of regeneration of an ion exchanger on a processing electrode member side and an ion exchanger on a feeding electrode member side, both in use for processing of a workpiece, as carried out in the electrolytic processing apparatus.

During electrolytic processing, in the ion exchanger (cation exchanger) 58 on the processing electrode member 52 side, as shown in FIG. 5 on the right side, ions such as dissolved ions $M^+$ of a to-be-processed material, which are being taken into the ion exchanger (cation exchanger) 58 during processing of the material, move toward the processing electrode (cathode) 56 side and pass through the diaphragm 60. The ions $M^+$ that have passed the diaphragm 60 are discharged out of the system by the flow of the discharging liquid A supplied between the diaphragm 60 and the processing electrode 56. The ion exchanger (cation exchanger) 58 is thus regenerated. When a cation exchanger is used as the diaphragm 60, the diaphragm (cation exchanger) 60 can permit permeation therethrough of only ions $M^+$ coming from the ion exchanger (cation exchanger) 58.

In the ion exchanger (anion exchanger) 68 on the feeding electrode member 54 side, on the other hand, as shown in FIG. 5 on the left side, ions $X^-$ in the ion exchanger (anion exchanger) 68 move toward the feeding electrode (anode) 66 side and pass through the diaphragm 70. The ions $X^-$ that have passed the diaphragm 70 are discharged out of the system by the flow of the discharging liquid A supplied between the diaphragm 70 and the feeding electrode 66. The ion exchanger (anion exchanger) 68 is thus regenerated. When an anion exchanger is used as the diaphragm 70, the diaphragm (anion exchanger) 70 can permit permeation therethrough of only ions $X^-$ coming from the ion exchanger (anion exchanger) 70.

Though in this embodiment a single liquid A is used as the liquid for discharging contaminants, it is also possible to use different types of liquids according to the types of impurity ions discharged from the ion exchangers.

If regeneration of the ion exchangers 58, 68, which are in contact with the substrate W and are in use for processing, is carried out, ions such as newly dissolved ions (metal ions) $M^+$ from the workpiece such as substrate W, for example, are constantly taken in the ion exchanger 58 on the processing electrode member 52 side. Accordingly, depending upon the processing conditions, all of the ions such as dissolved ions (metal ions) $M^+$ taken in the ion exchanger 58 cannot be fully discharged out of the system.

According to this embodiment, the regeneration dummy electrode 84 is provided to constitute, together with the above-described discharge portions 64, 74, an ion discharge mechanism and regeneration of the ion exchangers 58, 68 not in use for processing is carried out by utilizing the discharge portions 64, 74, whereby the exchangers 58, 68 can be regenerated with an enhanced regeneration rate of ion exchange capacity.

Figure 6:
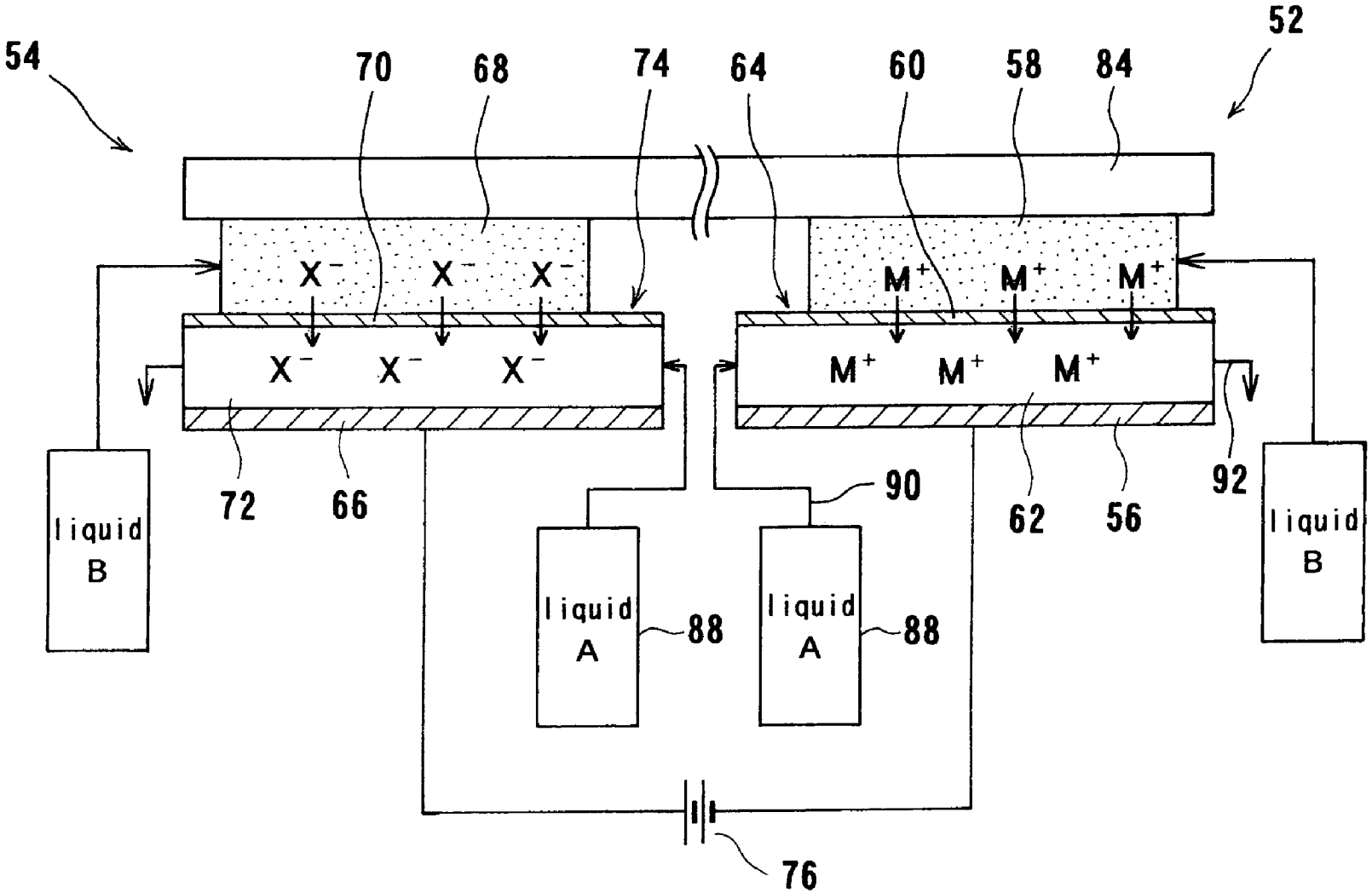
FIG. 6 is a diagram illustrating the principle of regeneration of an ion exchanger on a processing electrode member side and an ion exchanger on a feeding electrode member side, not in use for processing of a workpiece, as carried out by the regeneration electrode section of the electrolytic processing apparatus.

The mechanism of the regeneration will now be described with reference to FIG. 6. Since the regeneration mechanism on the feeding electrode member 54 side is the same as the above-described case shown in FIG. 5, a description thereof is here omitted.

When the regeneration dummy electrode 84, held by the regeneration dummy electrode holding section 36, is close to or in contact with the ion exchangers 58, 68 not in use for processing, a discharging liquid A for discharging contaminants is supplied from the discharging liquid supply source 88 to the discharge passages 62, 72, and a liquid B, such as pure water, is supplied from the pure water supply nozzle 78 (see FIG. 3) to between the regeneration dummy electrode 84 and the ion exchangers 58, 68, while a voltage is applied from the power source 76 between the processing electrode 56 as a cathode and the feeding electrode 66 as an anode, thereby carrying out regeneration of the ion exchangers 58, 68.

During the regeneration, as with the above-described case shown in FIG. 5, ions such as dissolved ions M+from a to-be-processed material, which have been taken into the ion exchanger (cation exchanger) 58 on the processing electrode member 52 side, move toward the processing electrode (cathode) 56 and pass through the diaphragm 60. The ions $M^+$ that have passed through the diaphragm 60 are discharged out of the system by the flow of the discharging liquid A supplied into the discharge passage 62 between the diaphragm 60 and the processing electrode 56. The ion exchanger (cation exchanger) 58 is thus regenerated. Differently from the above-described in-process regeneration shown in FIG. 5, however, the ion exchanger 58 is close to or in contact with the regeneration dummy electrode 84 having a regeneration surface without dissolution of metal ions upon electrolytic processing, there is no taking-in of ions such as dissolved ions (metal ions) by the ion exchanger 58 during the regeneration. Ions such as dissolved ions (metal ions), which have been taken in the ion exchanger 58 and have not been removed by the above-described in-process regeneration, and remain in the ion exchanger 58, can be removed by the regeneration.

Processing of a substrate (electrolytic processing of the substrate and regeneration of an ion exchanger) by the electrolytic processing apparatus 30 will now be described. In the following description, for convenience' sake, the electrode members 52, 54 positioned in the right half area $S_1$ of the electrode section 34 shown in FIG. 4 are regarded as electrode members in use for processing, while the electrode members 52, 54 positioned in the left half area $S_2$ are regarded as electrode members not in use for processing.

First, a substrate W is attracted and held by the substrate holder 42 of the substrate holding section 32, and the substrate holding head 38 is located at a predetermined position above the right half area $S_1$ of the electrode section 34. Next, the substrate holder 42 is lowered to bring the substrate W, held by the substrate holder 42, close to or into contact with the surfaces of the ion exchangers 58, 68 of the electrode members 52, 54 mounted on the upper surface of the electrode section 34. On the other hand, the regeneration electrode head 80 of the regeneration dummy electrode holding section 36 is located at a predetermined position above the left half area $S_2$ of the electrode 34, and the cylinder 86 is actuated to lower the regeneration electrode head 80 so as to bring the regeneration dummy electrode 84 into contact with the surfaces of the ion exchangers 58, 68 of the electrode members 52, 54 at a predetermined pressure.

The substrate holder 42 is then rotated while applying a given voltage from the power source 76 to between the processing electrodes 56 and the feeding electrodes 66. The ion exchangers 58, 68 of the electrode members 52, 54 positioned in the right half area $S_1$ of the electrode section 34 and the substrate W held by the substrate holder 42 are thus moved relative to each other while they are allowed to be close to or in contact with each other. At the same time, a processing liquid such as pure water, preferably ultrapure water is supplied through the pure water supply nozzles 78 to between the substrate W and the ion exchangers 58, 68, and between the regeneration dummy electrode 84 and the ion exchangers 58, 68. Further, a discharging liquid for discharging contaminants is supplied into the discharge passages 62, 72 provided in the discharge portions 64, 74 so that the discharge passages 62, 72 are filled with the discharging liquid, and the discharging liquid flows in one direction in the discharge passages 62, 72 and flows out of the system.

Figure 1A:
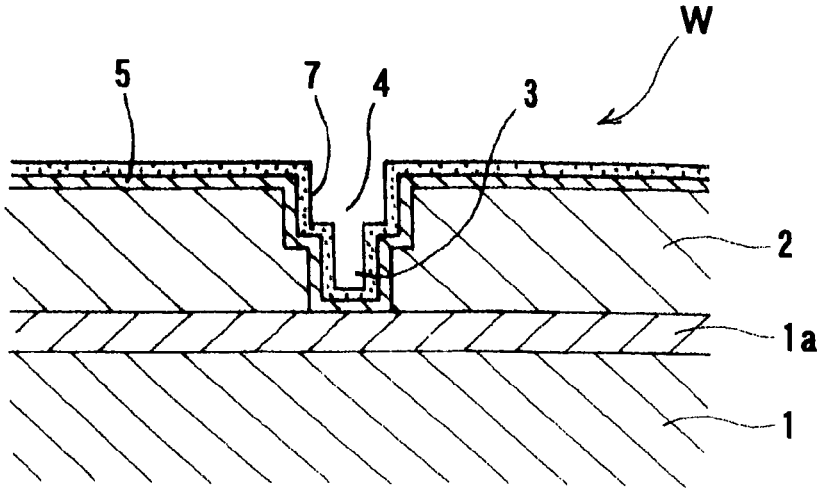
FIGS. 1A through 1C are diagrams illustrating, in sequence of process steps, an example of the formation of copper interconnects.
Figure 1B:
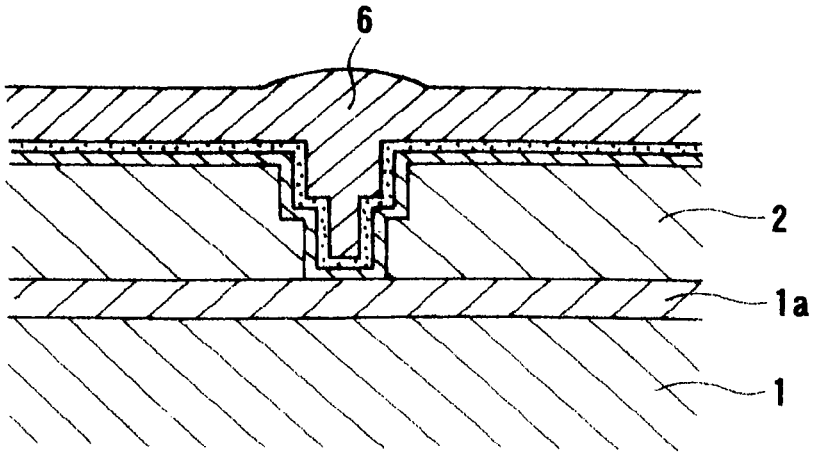
Figure 1C:
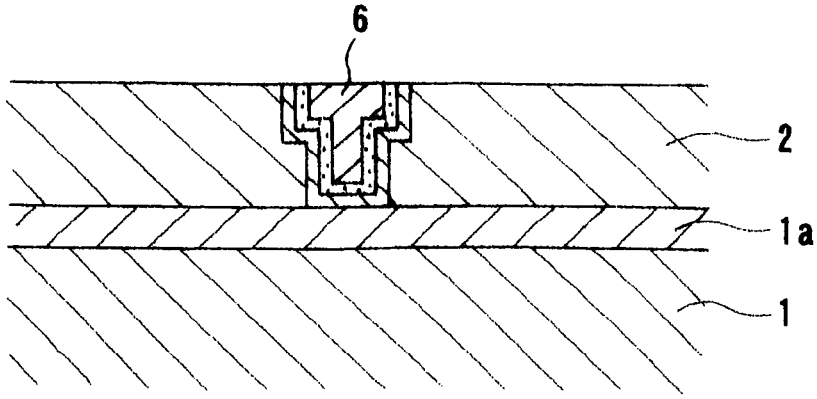
Figure 2:
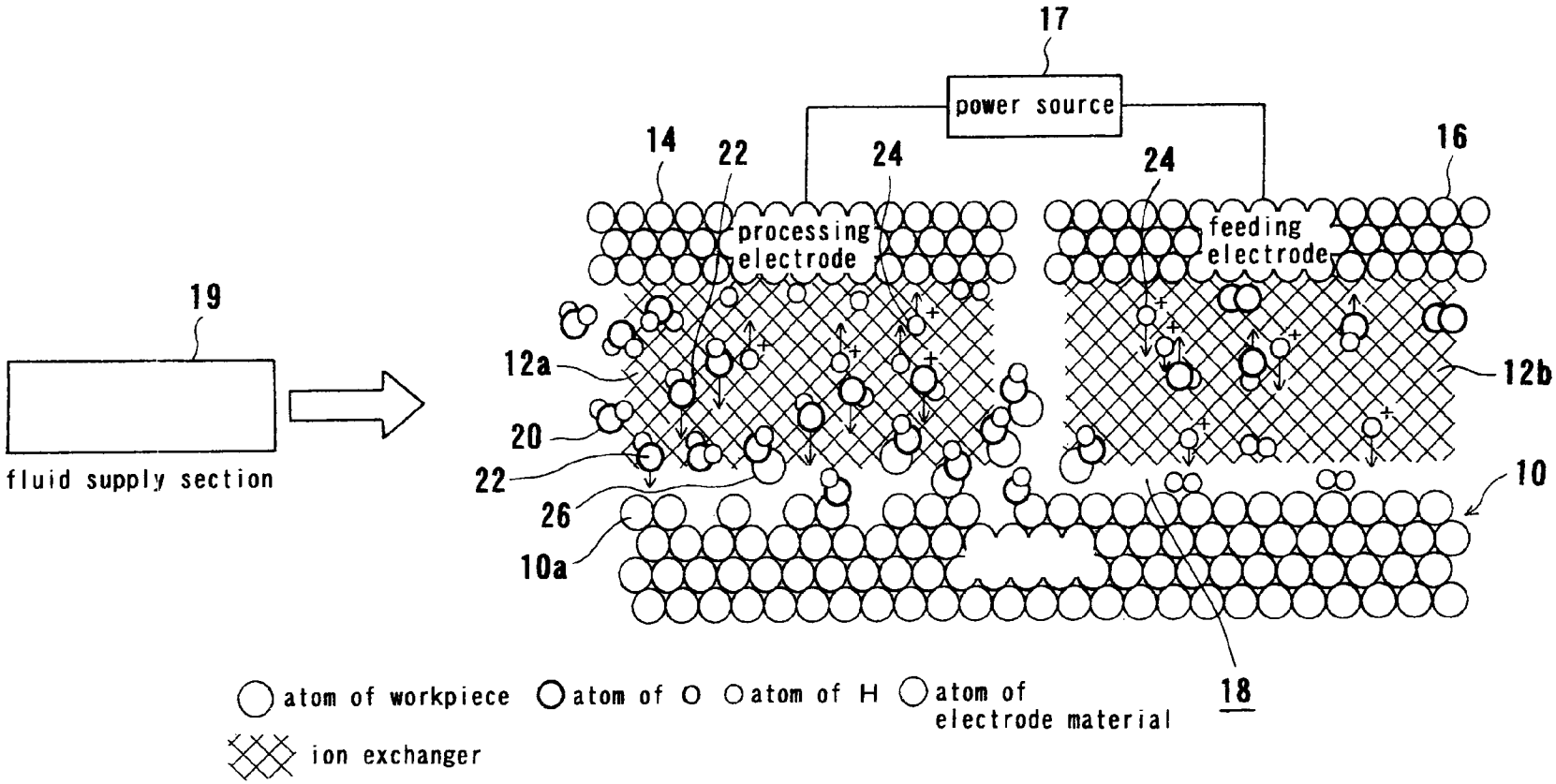
FIG. 2 is a diagram illustrating the principle of electrolytic processing using an ion exchanger.

In the right half area $S_1$ of the electrode section 34, the electrode reaction and the migration of ions in the ion exchangers 58, 68 are caused by the above operation to effect electrolytic processing of e.g. the copper film 6 shown in FIG. 1B formed on the substrate W. At the same time, through the ion-exchange reaction with the ion exchangers 58, 68 as a solid electrolyte, the ions in the ion exchangers 58, 68 are moved toward the processing electrode 56 and the feeding electrode 66, passed through the diaphragms 60, 70, and introduced into the discharge passages 62, 72. The ions in the discharge passages 62, 72 are discharged out of the system by the flow of the discharging liquid supplied into the discharge passages 62, 72. Regeneration of the ion exchangers 58, 68 of the electrode members 52, 54 in use for processing is thus effected.

In the left half area $S_2$ of the electrode section 34, regeneration of the ion exchangers 58, 68 not in use for processing, without involving electrolytic processing, is effected in the above-described manner. Regeneration of the ion exchangers 58, 68 of the electrode members 52, 54 positioned in the left half area $S_2$ of the electrode section 34, can be effected with an enhanced regeneration rate of ion-exchange capacity. During the regeneration of the ion exchangers 58, 68 of the electrode members 52, 54 positioned in the left half area $S_2$ of the electrode section 34, the regeneration electrode head 80 is moved slowly in the lateral direction, or, after moving upwardly, it is moved in the lateral direction and is then lowered, thereby carrying out regeneration of the entire surfaces of the ion exchangers 58, 68 of the electrode members 52, 54 positioned in the area $S_2$.

In a processing electrode member 52 using a cation exchanger as the ion exchanger 58, cations taken into the ion exchanger 58 pass through the diaphragm 60 into the discharge passage 62. In a feeding electrode member 54 using an anion exchanger 68, on the other hand, anions taken into the ion exchanger 68 pass through the diaphragm 70 into the discharge passage 72. The ion exchangers 58, 68 are thus regenerated.

By allowing the processing liquid, such as pure water or ultrapure water, to flow in the ion exchangers 58, 68, electrolytic processing can be carried out efficiently.

As described above, the use as diaphragms 60, 70 of ion exchangers respectively having the same ion-exchange group as the ion exchangers 58, 68 to be regenerated, allows impurity ions in the ion exchangers 58, 68 to migrate through the diaphragms (ion exchangers) 60, 70, without inhibition of their permeation through the diaphragms 60, 70, thereby avoiding an increase in the power consumption. Further, the discharging liquid (including ions in the liquid) flowing between the diaphragms 60, 70 and the electrodes 56, 66 can be prevented from permeating through the diaphragms 60, 70 into the ion exchanger 58, 68 side, thereby preventing re-contamination of the regenerated ion exchangers 58, 68. Further, a discharging liquid, which has a high electric conductivity (dielectric constant) and does not form an insoluble compound through a reaction with ions removed from the ion exchangers 58, 68, may be supplied between the diaphragms 60, 70 and the electrodes 56, 66. This can lower the electric resistance of the discharging liquid and thereby lower the power consumption in the regeneration section. In addition, since there is no formation of an insoluble compound (by-product), there is no fear of adhesion of the insoluble compound to the diaphragms 60, 70 which would cause uncontrollable change of the electric resistance between the processing electrodes 56 and the feeding electrodes 66.

After the completion of electrolytic processing, the processing electrodes 56 and the feeding electrodes 66 are disconnected from the power source 76, and the rotation of the substrate holder 42 is stopped. Thereafter, the substrate holder 42 is raised and the substrate holding head 38 is moved horizontally in the lateral direction to send the substrate W after electrolytic processing to the next process step. On the other hand, the regeneration electrode head 80 of the regeneration dummy electrode holding section 36 is raised to terminate regeneration of the ion exchangers 58, 68 of the electrode members 52, 54 positioned in the area $S_1$ of the electrode section 34.

When carrying out electrolytic processing next, the positional relationship between the substrate holding section 32 and the regeneration dummy electrode holding section 36 is reversed, i.e., the substrate holding section 32 is positioned opposite the left half area $S_2$ of the electrode section 34 and the regeneration dummy electrode holding section 36 is positioned opposite the right half area $S_1$. Processing of a substrate W, held by the substrate holder 42 of the substrate holding section 32, using the electrode members 52, 54 positioned in the left half area $S_2$ of the electrode section 34 and regeneration of the ion exchangers 58, 68 of the electrode members 52, 54 in use for the processing are carried out simultaneously in the same manner as described above. At the same time, regeneration of the ion exchangers 58, 68 of the electrode members 52, 54 positioned in the right half area $S_1$ and not in use for processing is carried out.

According to this embodiment, the electrode members 52, 54 for use in electrolytic processing are separated from the electrode members 52, 54 only for regeneration without use in electrolytic processing. It is, however, also possible to move the substrate holding head 38 of the substrate holding section 32 and the regeneration electrode head 80 of the regeneration dummy electrode holding section 36 in the lateral direction and in synchronization so that the ion exchangers 58, 68 of the electrode members 52, 54, which have been used in electrolytic processing, can be regenerated successively by the regeneration dummy electrode holding section 36.

In this embodiment, pure water, preferably ultrapure water is supplied between the substrate W and ion exchangers 58, 68, and between the regeneration dummy electrode 84 and the ion exchangers 58, 68. The use of pure water or ultrapure water containing no electrolyte upon electrolytic processing can prevent extra impurities such as an electrolyte from adhering to and remaining on the surface of the substrate W. Further, copper ions or the like dissolved during electrolytic processing are immediately caught by the ion exchangers 58, 68 through the ion-exchange reaction. This can prevent the dissolved copper ions or the like from re-precipitating on other portions of the substrate W, or from being oxidized to become fine particles which contaminate the surface of the substrate W.

Ultrapure water has a high resistivity, and therefore it is difficult for an electric current to flow therethrough. A lowering of the electric resistance is made by making the distance between the electrode and a workpiece as small as possible, or by interposing the ion exchanger between the electrode and a workpiece. Further, an electrolytic solution, when used in combination with ultrapure water, can further lower the electric resistance and reduce the power consumption. When electrolytic processing is conducted by using an electrolytic solution, the portion of a workpiece that undergoes processing ranges over a slightly wider area than the area of the processing electrode. In the case of the combined use of ultrapure water and the ion exchanger, on the other hand, since almost no electric current flows through ultrapure water, electric processing is effected only within the area of a workpiece that is equal to the area of the processing electrode and the ion exchanger.

It is possible to use, instead of pure water or ultrapure water, an electrolytic solution obtained by adding an electrolyte to pure water or ultrapure water. The use of an electrolytic solution can further lower the electric resistance and reduce the power consumption. A solution of a neutral salt such as NaCl or $Na_2SO_4$, a solution of an acid such as HCl or $H_2SO_4$, or a solution of an alkali such as ammonia, may be used as the electrolytic solution, and these solutions may be selectively used according to the properties of the workpiece. When using an electrolytic solution, it is preferable to perform a non-contact process by providing a slight gap between the substrate W and the ion exchanger 58, 68.

Further, it is also possible to use, instead of pure water or ultrapure water, a liquid obtained by adding a surfactant to pure water or ultrapure water, and having an electric conductivity of not more than 500 μS/cm, preferably not more than 50 μS/cm, more preferably not more than 0.1 μS/cm (resistivity of not less than 10 MΩ·cm). Due to the presence of a surfactant in pure water or ultrapure water, the liquid can form a layer, which functions to inhibit ion migration evenly, at the interface between the substrate W or the regeneration dummy electrode 84 and the ion exchangers 58, 68, thereby moderating concentration of ion exchange (metal dissolution) to enhance the flatness of the processed surface. The surfactant concentration is desirably not more than 100 ppm. When the value of the electric conductivity is too high, the current efficiency is lowered and the processing rate is decreased. The use of a liquid having an electric conductivity of not more than 500 μS/cm, preferably not more than 50 μS/cm, more preferably not more than 0.1 μS/cm, can attain a desired processing rate.

If a voltage is raised to increase the current density in order to enhance the processing rate, an electric discharge can occur when the electric resistance between the electrode and the substrate (workpiece) is large. The occurrence of electric discharge causes pitching on the surface of the workpiece, thus failing to form an even and flat processed surface. To the contrary, since the electric resistance is very small when the ion exchangers 58, 68 are in contact with the substrate W, the occurrence of an electric discharge can be avoided.

Figure 7:
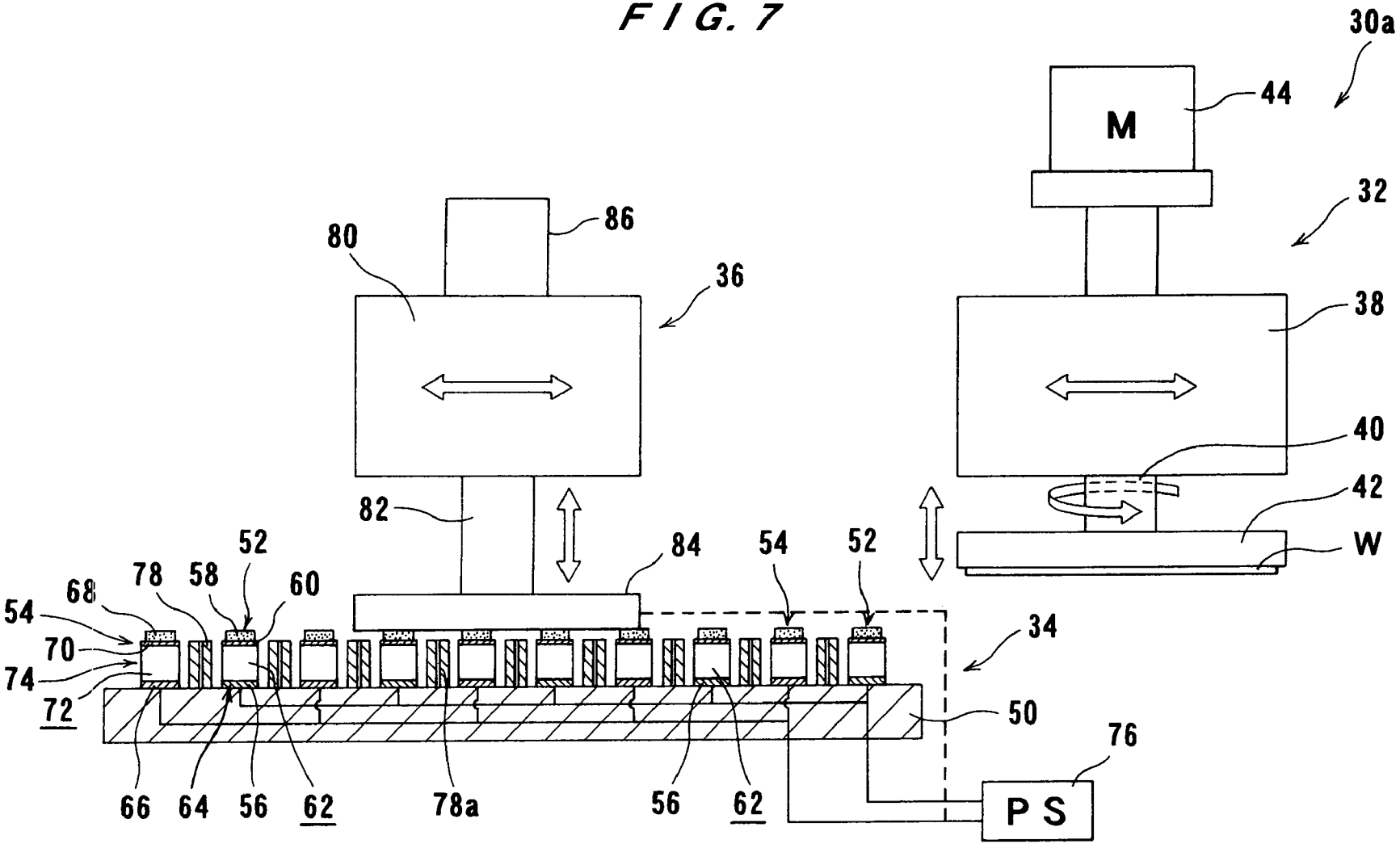
FIG. 7 is a vertical sectional front view of an electrolytic processing apparatus according to another embodiment of the present invention.

FIG. 7 shows an electrolytic processing apparatus 30*a* according to another embodiment of the present invention. The electrolytic processing apparatus 30*a* differs from the apparatus of the preceding embodiment in that the substrate holding section 32 and the regeneration dummy electrode holding section 36 are separated from each other, and electrolytic processing of a substrate W, held by the substrate holder 42 of the substrate holding section 32, and regeneration of the ion exchangers 58, 68 in use for processing by the electrode section 34, and regeneration of the ion exchangers 58, 68 of the electrode members 52, 54, not in use for processing, of the electrode section 34 by the regeneration dummy electrode holding section 36 are respectively carried out independently.

By thus making the regeneration of ion exchangers 58, 68 of the electrode members 52, 54 of the electrode section 34 by the regeneration dummy electrode holding section 36 independent of the electrolytic processing by the electrode section 34 as well as the regeneration of the ion exchangers 58, 68 of the electrode members 52, 54 in use for processing, control of the electrode section 34 and the substrate holding section 32, and control of the electrode section 34 and the regeneration dummy electrode holding section 36 can be performed separately, making it possible to carry out the respective operations under the optimum conditions.

In this embodiment, as shown by the broken line in FIG. 7, it is possible to connect the anode of the power source 76 to the regeneration dummy electrode 84 so as to effect regeneration of the ion exchanger 58 on the processing electrode member 52 side stably and efficiently.

Figure 8:
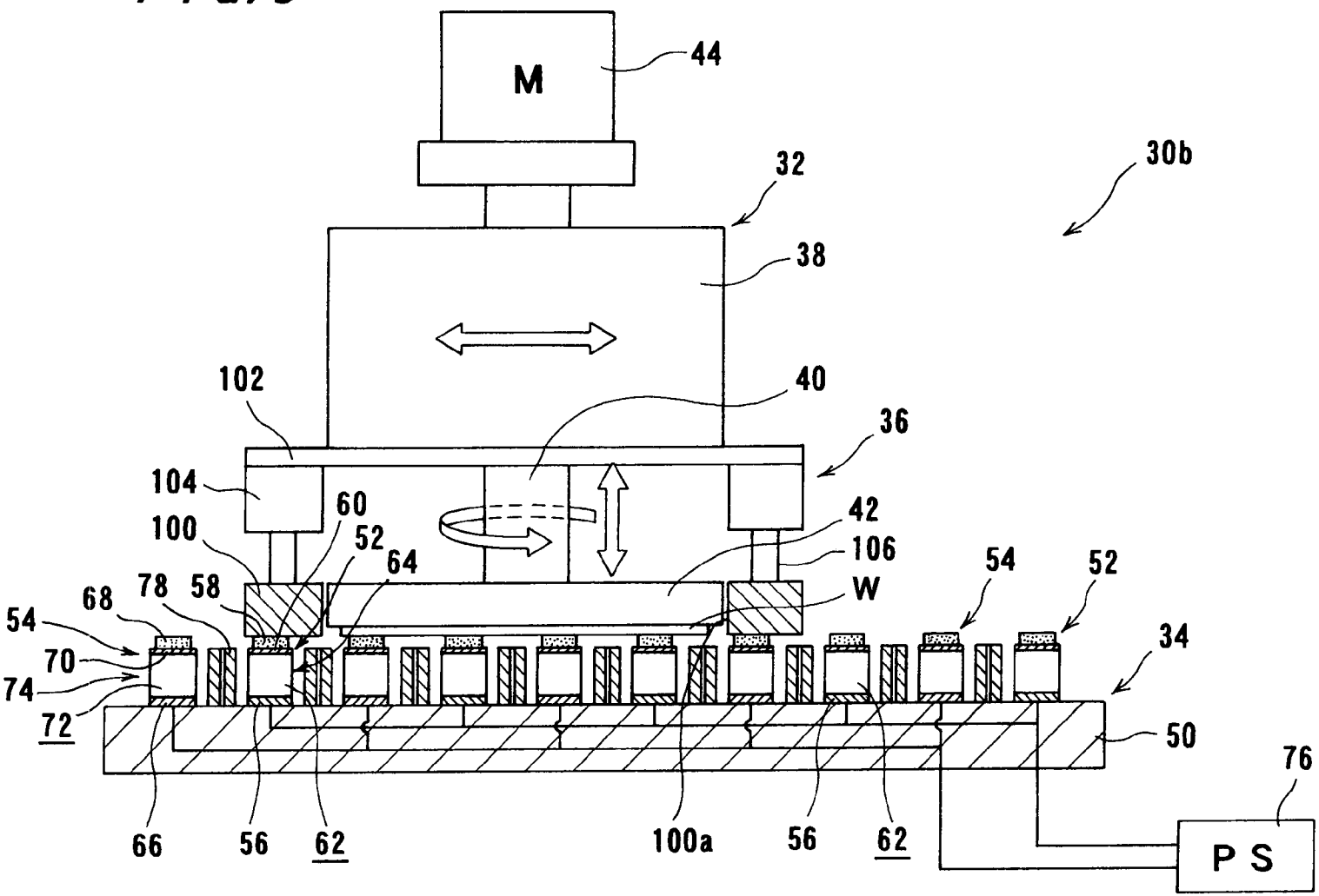
FIG. 8 is a vertical sectional front view of an electrolytic processing apparatus according to yet another embodiment of the present invention.

FIG. 8 shows an electrolytic processing apparatus 30*b* according to yet another embodiment of the present invention. According to the electrolytic processing apparatus 30*b* of this embodiment, the substrate holding section 32 and the regeneration dummy electrode holding section 36 are integrated. In particular, the regeneration dummy electrode holding section 36 of this embodiment includes a rectangular tabular regeneration dummy electrode 100 having a central hole 100*a* conforming to the outer shape of the substrate holder 42. The regeneration dummy electrode 100 is couple to the lower ends of the cylinder rods 106 of cylinders 104 mounted to a base plate 102 which is fixed to the lower surface of the substrate holding head 38 of the substrate holding section 32. The substrate holder 42 is positioned in the central hole 100*a* of the regeneration dummy electrode 100 and thus is surrounded by the regeneration dummy electrode 100. The other construction is the same as the preceding embodiments.

According to this embodiment, electrolytic processing of a substrate W, held by the substrate holder 42, by the electrode members 52, 54 close to or in contact with the substrate W as well as regeneration of the ion exchangers 58, 68 of the electrode members 52, 54 in use for processing can be carried out simultaneously with regeneration, not involving processing, of the ion exchangers 58, 68 of the electrode members 52, 54 not in use for processing and positioned beside the electrode members 52, 54 in use for processing.

Though the regeneration dummy electrode 100 in a rectangular tabular shape and having the central hole 100*a* is employed in this embodiment, it is also possible to use a ring-shaped electrode.

Figure 9:
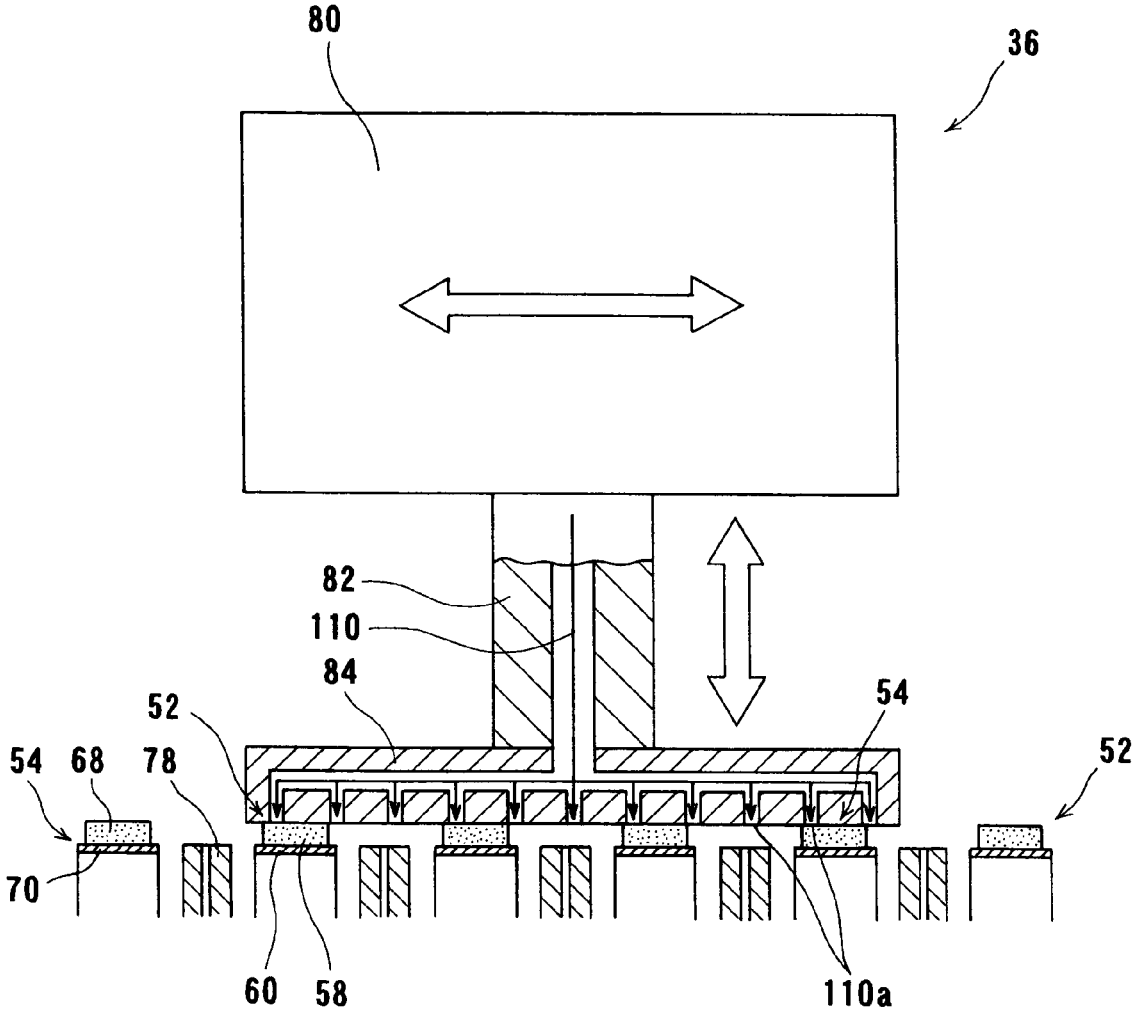
FIG. 9 is a schematic diagram showing another regeneration electrode section.

As shown in FIG. 9, it is possible to provide, within the regeneration dummy electrode holding section 36, a fluid supply section 110 having a plurality of jet orifices 110*a* opening in the regeneration surface (lower surface) of the regeneration dummy electrode 84, and supply a fluid through the fluid supply section 110 to between the regeneration dummy electrode 84 and the ion exchangers 58, 68.

Figure 10:
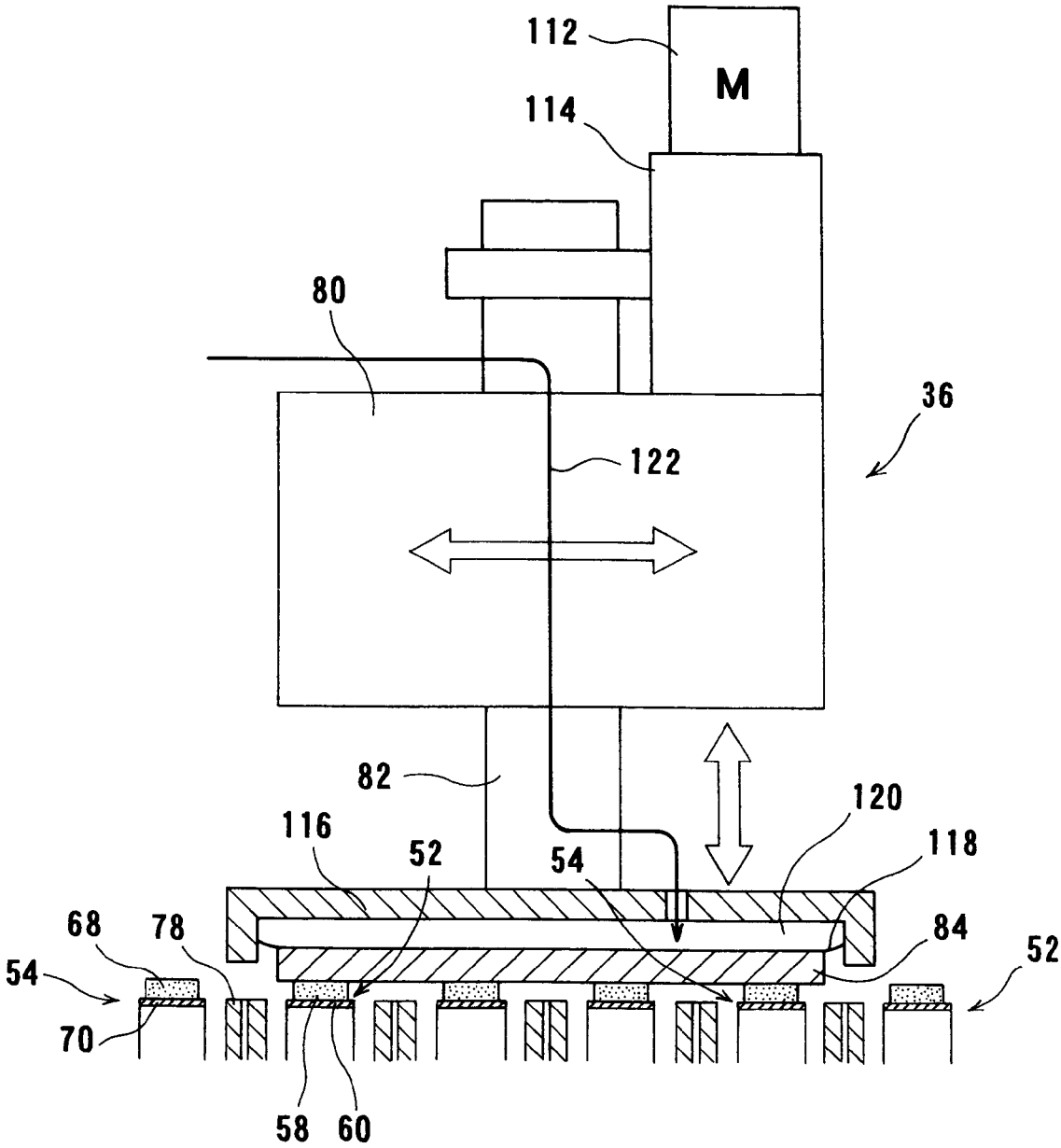
FIG. 10 is a schematic diagram showing yet another regeneration electrode section.

Further, as shown in FIG. 10, it is possible to move the lifting shaft 82 up and down with a lifting motor 112 and a ball screw 114; and form a fluid chamber 120, sealed water-tightly with an elastic membrane 118, between the regeneration dummy electrode 84 and a housing 116, and connect a pressurized fluid supply line 122 to the fluid chamber 120, thereby constituting a contact pressure control section for controlling the contact pressure of the regeneration dummy electrode 84 on the ion exchangers 58, 68. In this case, the contact pressure of the regeneration dummy electrode 84 on the ion exchangers 58, 68 can be controlled by adjusting the pressure of the fluid to be introduced into the fluid chamber 120.

The construction of the regeneration section shown in FIG. 9 or 10 can be applied to all regeneration sections described in this application.

Figure 11:
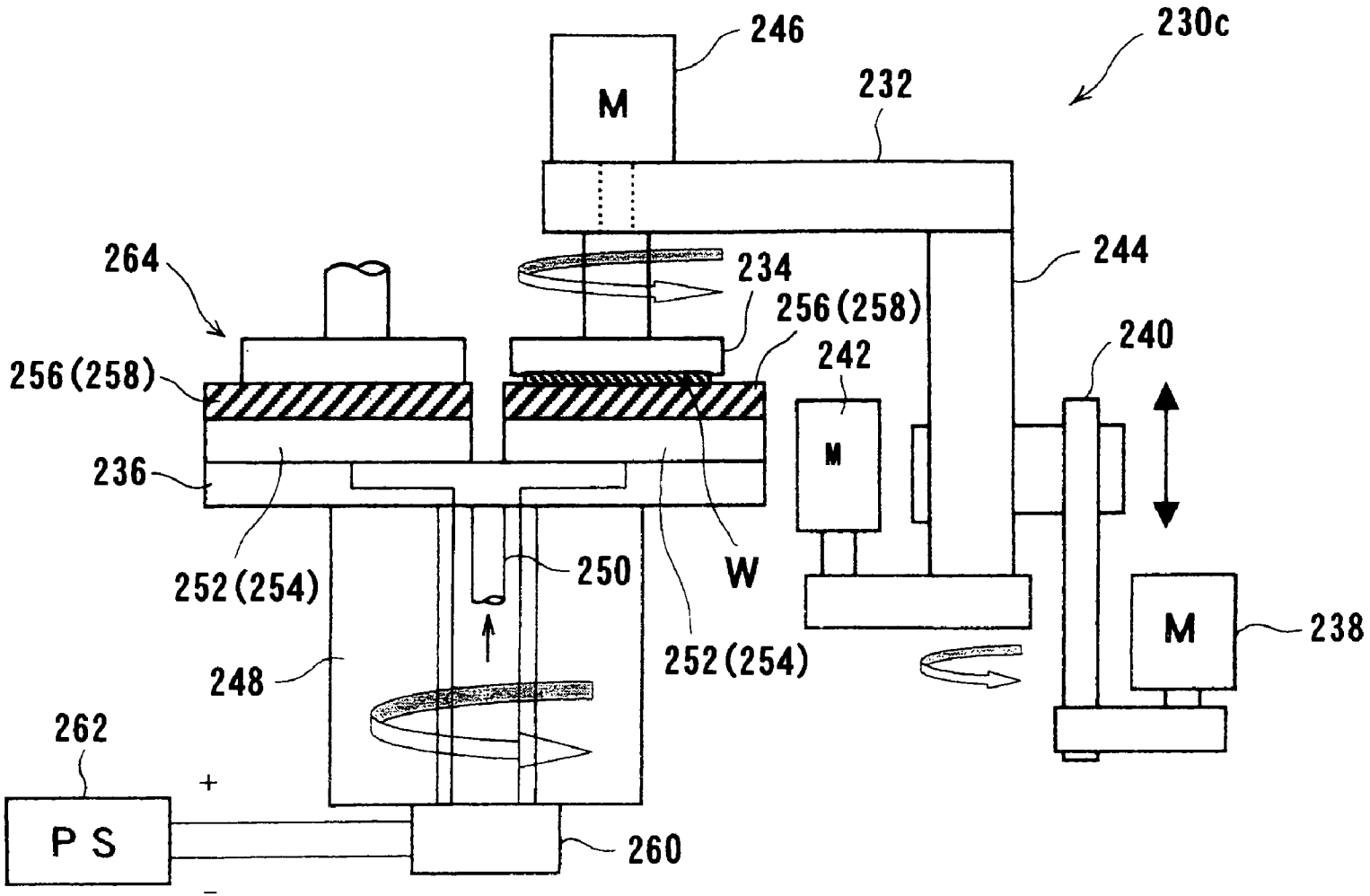
FIG. 11 is a vertical sectional view of an electrolytic processing apparatus according to yet another embodiment of the present invention.

FIG. 11 is a vertical sectional view of an electrolytic processing apparatus 30*c* according to yet another embodiment of the present invention. As shown in FIG. 11, the electrolytic processing apparatus 30*c* includes a substrate holder 234, mounted vertically to a free end of a horizontally-pivotable pivot arm 232, for attracting and holding a substrate W with its front surface facing downwardly (face down), and a disc-shaped processing table 236 formed of an insulating material, provided below the substrate holder 234. According to this embodiment, the processing table 236 has a diameter at least twice the diameter of the substrate W held by the substrate holder 234 so that the entire surface of the substrate W can be processed electrically.

The pivot arm 232 is coupled to the upper end of a pivot shaft 244 which moves vertically through a ball screw 240 by the actuation of a vertical movement motor 238 and rotates by the actuation of a pivoting motor 242. The substrate holder 234 is connected to a rotating motor 246 mounted on the free end of the pivot arm 232, and rotates by the actuation of the rotating motor 246.

The processing table 236 is connected directly to a hollow motor 248, and rotates by the actuation of the hollow motor 248. A pure water flow passage (not shown) for supplying pure water, preferably ultrapure water, is provided in the interior of the processing table 236. The pure water flow passage is connected to a pure water supply pipe 250 extending through the hollow portion of the hollow motor 248. Pure water, preferably ultrapure water is supplied from the pure water supply pipe 250, via the pure water flow passage within the processing table 236, to the below-described contact members (ion exchangers) 256, 258 having water-absorbing properties, and is then supplied onto the entire processing surface of the substrate W held by the substrate holder 234.

Figure 12:
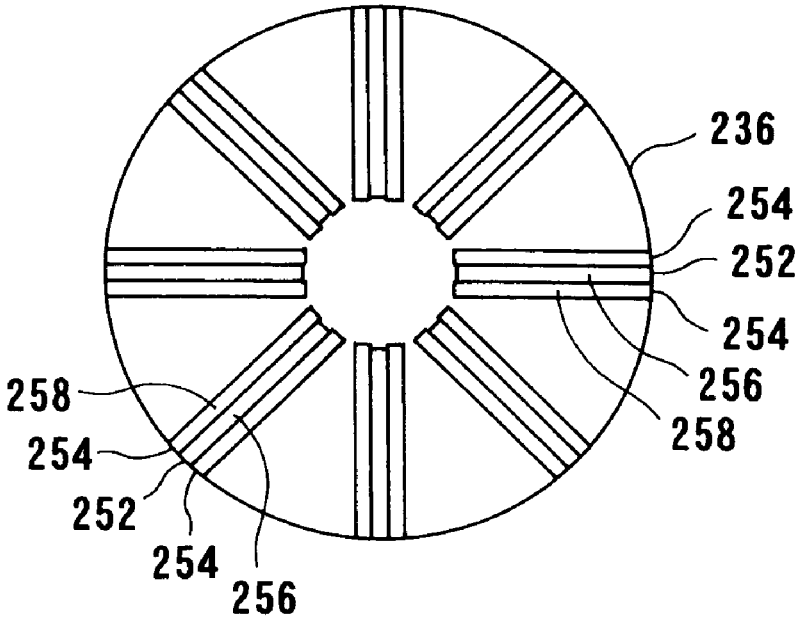
FIG. 12 is a plan view of the processing table of the electrolytic processing apparatus shown in FIG. 11.

As shown in FIG. 12, a plurality of radially-extending processing electrodes 252 is provided on the front surface (upper surface) of the processing table 236, and a pair of linearly-extending feeding electrodes 254 is disposed on either side of each processing electrode 252. A contact member 256 is provided on the upper surface (front surface) of each processing electrode 252, and a contact member 258 is provided also on the upper surface (front surface) of each feeding electrode 254.

In this embodiment, the processing electrodes 252 are connected to the cathode of a processing power source 262 via a slip ring 260, while the feeding electrodes 254 are connected to the anode of the processing power source 262 via the slip ring 260.

Figure 13:
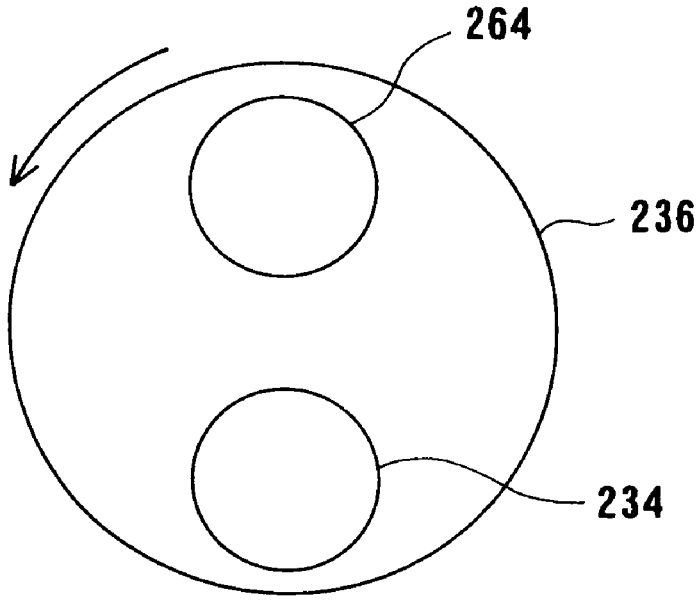
FIG. 13 is a schematic plan view of the electrolytic processing apparatus of FIG. 11.

As shown in FIG. 13, a vertically-movable disc-shaped regeneration section 264 is disposed above the processing table 236 and in a position parallel to the substrate 234 and on the opposite side of the central axis of the processing table 236 from the substrate holder 234. The regeneration section 264 is to come into contact with the contact members 256, 258 covering the front surfaces (upper surfaces) of the processing electrodes 252 and the feeding electrodes 254 to regenerate the contact members 256, 258 during processing of the substrate W held by the substrate holder 234.

Figure 14:
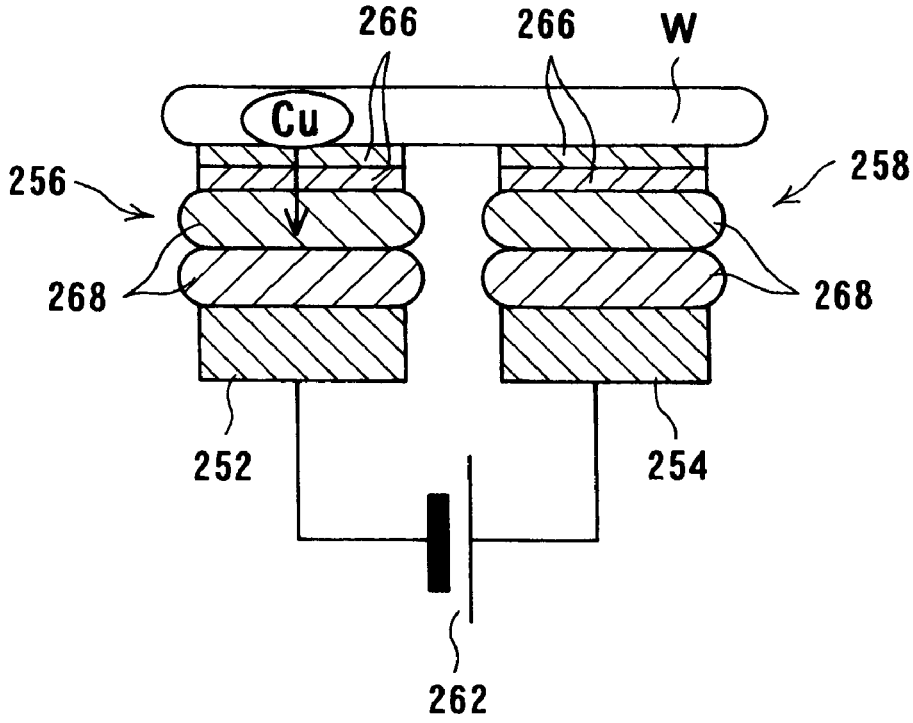
FIG. 14 is a diagram illustrating, on a larger scale, the relationship between a substrate, the processing electrode and the feeding electrode of the electrolytic processing apparatus shown in FIG. 11.
Figure 15:
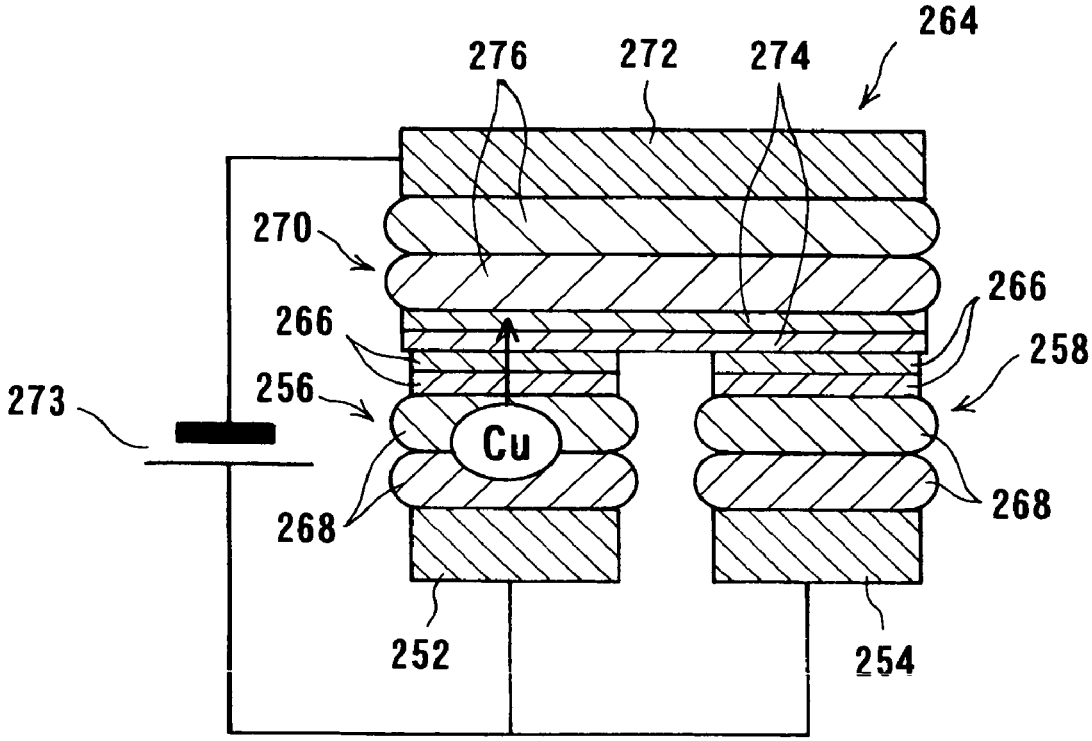
FIG. 15 is a diagram illustrating, on a larger scale, the relationship between the regeneration section, the processing electrode and the feeding electrode of the electrolytic processing apparatus shown in FIG. 11.

There are ion exchangers having various properties. For example, an ion-exchange membrane with a smooth surface, though excellent in the ability of eliminating a level difference in, for example, polishing processing of copper on a surface of a substrate, has a small ion-exchange capacity. An ion-exchange membrane of a non-woven fabric, though poor in the ability of eliminating a level difference, has a large ion-exchange capacity. As shown in FIGS. 14 and 15, each contact member 256 and each contact member 258 are respectively comprised of a multi-layer (four-layer) laminate of two types of ion exchangers 266, 268 each comprised of a two-layer laminate and having such properties. The lamination of the two types of ion exchangers can compensate for each other's defects.

In the case of laminating the ion exchangers 266, 268 to constitute the contact members 256, 258, the ion exchangers 266, 268 are required to satisfy the following requirements:

(1) Removal of Processing Products (Including a Gas)

This is closely related to stability of the processing rate and evenness in the distribution of processing rate. To meet this demand, it is preferable to use an ion exchanger having "water permeability" and "water-absorbing properties". By the term "water permeability" herein is meant a permeability in a broad sense. Thus, the member, which itself has no water permeability but can permit permeation therethrough of water by the provision of holes or grooves, is herein included as a "water-permeable" member. The term "water-absorbing properties" means properties of absorbing water and allowing water to penetrate into the material.

(2) Stability of Processing Rate

To meet this demand, it is desirable to use a multi-layer laminated ion exchanger, thereby securing an adequate ion-exchange capacity.

(3) Flatness of Processed Surface (Ability of Eliminating a Level Difference)

To meet this demand, the processing surface of the ion exchanger desirably has a good surface smoothness. Further, in general, the harder the member is, the flatter is the processed surface (ability of eliminating a level difference).

(4) Long Life

In the light of long mechanical life of the member, it is desirable to use an ion-exchange material having a high wear resistance.

It is preferred that the upper two-layer ion exchanger 266 of the contact members 256, 258, which is to face a substrate (workpiece) W, have a higher hardness than the lower two-layer ion exchanger 268 and good surface smoothness. According to this embodiment, Nafion (trademark of DuPont) with a thickness of 0.2 mm is employed. The term "high hardness" herein means high rigidity and low compression set. The ion exchanger 266, as a processing member, made of a material having a high hardness, when used in the processing of a workpiece having fine irregularities in the surface, such as a wafer having an interconnected pattern, hardly follows the irregularities and is likely to selectively remove the raised portions of the pattern. The expression "has a smooth surface" herein means that the surface has few irregularities. Anion exchanger having a smooth surface smoothness is less likely to contact the recesses in the surface of a workpiece, such as a wafer having an interconnected pattern, and is more likely to selectively remove the raised portions of the pattern.

It is preferred to use, as the lower two-layer ion exchanger 268 of the contact members 256, 258, an ion exchanger having a large ion-exchange capacity. According to this embodiment, a C-membrane (non-woven fabric ion exchanger) with a thickness of 1 mm is used to increase the total ion-exchange capacity. The ion exchanger 268 may be of a single membrane provided its ion-exchange capacity is sufficiently large.

By thus combining the ion exchanger 266 having a surface smoothness with the ion exchanger 268 having a large ion exchange capacity to constitute the contact members 256, 258, the defect of small ion exchange capacity of the ion exchanger 266 can be compensated for by the ion exchanger 268. Thus, taking-in of processing products is primarily performed by the ion exchanger 268 having a large ion-exchange capacity, while processing of the substrate W is performed by the ion exchanger 266 having a surface smoothness, thereby effecting a high-precision processing with a large processing amount.

Further, it is preferred that the upper two-layer ion exchanger 266 have an excellent water-permeability. By allowing pure water or ultrapure water to flow through the ion exchanger 266, a sufficient amount of water can be supplied to a functional group (sulfonic acid group in the case of a strongly-acidic cation-exchange material) to thereby increase the amount of dissociated water molecules, and the products (including a gas) generated by the reaction between a processing object and hydrogen ions (or OH radicals) can be removed by the flow of water, whereby the processing efficiency can be enhanced. The flow of pure water or ultrapure water is therefore necessary, and the flow of pure water or ultrapure water should desirably be constant and uniform. The constancy and uniformity of the flow of water leads to constancy and uniformity in the supply of ions and the removal of processing products, thus ensuring a constant and uniform processing efficiency. In the case where the material of the ion exchanger 266 has no water-permeability, the ion exchanger 266 may be made water-permeable to pass water therethrough by forming holes in it. If the ion exchanger 266 has poor water-permeability, it is preferred to supply sufficient water to both surfaces of the ion exchanger 266.

As with the above-described embodiments, the ion exchangers 266, 268 may be made of a non-woven fabric having an anion-exchange group or a cation-exchange group.

Though in this embodiment the ion exchangers 266, 268 are used as the contact members 256, 258, it is also possible to use, for example, a pad of a liquid-permeable non-woven fabric or a porous sponge instead of the ion exchangers 266, 268. Further, the contact member may be made liquid-permeable by forming holes in it. This holds also for the below-described embodiments.

As shown in FIG. 15, the regeneration section 264 includes a regeneration member 270 to come into contact with the contact members 256, 258 comprised of the ion exchangers 266, 268, and a regeneration electrode 272 disposed on the opposite side of the regeneration member 270 from the contact members 256, 258. Similarly to the contact members 256, 258, the regeneration member 270 is comprised of a two-layer ion exchanger 274 having a surface smoothness, for example, Nafion (trademark of DuPont) with a thickness of e.g. 0.2 mm, and a two-layer ion exchanger 276 having a large ion-exchange capacity, for example, C-membrane (non-woven ion exchanger) with a thickness of e.g. 1 mm. The ion exchanger 274 positioned on the front surface (lower surface) comes into contact with the front surfaces (upper surfaces) of the contact members 256, 258 and functions as a diaphragm.

The regeneration electrode 272 may be produced, for example, by plating or coating platinum or iridium onto a titanium electrode base, followed by sintering at a higher temperature to stabilize and strengthen the electrode.

As shown in FIG. 15, the regeneration electrode 272 is connected to the cathode of a regeneration power source 273, and the processing electrodes 252 and the feeding electrodes 254 are connected to the anode of the regeneration electrode 273 to apply a voltage, so that impurities ions, etc. taken in the ion exchangers 266, 268, constituting the contact members 256, 258, are moved toward the regeneration member 270 and taken in the regeneration member 270. The contact members 256, 258 are thus regenerated.

When carrying out electrolytic processing of copper by using, for example, a cation exchanger having cation-exchange groups as the ion exchangers 266, 268, constituting the contact members 256, 258, most of the ion-exchange groups of the ion exchangers (cation exchangers) 266, 268 are occupied by copper after processing, which lowers the processing efficiency of the next processing. When carrying out electrolytic processing of copper by using as the ion exchangers 266, 268 an anion exchanger having anion-exchange groups, on the other hand, fine particles of copper oxide are generated and the particles adhere to the surfaces of the ion exchangers (anion exchangers) 266, 268. Such particles on the ion exchangers can contaminate the surface of the next substrate to be processed. According to this embodiment, cation exchangers are used as the ion exchangers 266, 268, and the ion exchangers 266, 268, which have been in contact with the substrate W and used for processing, are regenerated by the regeneration section 264 during processing.

It is necessary that the regeneration member 270 not hinder the migration of impurity ions, etc., removed from the contact members 256, 258 to be regenerated, i.e. the ion exchangers 266, 268. Ion exchangers can permit selective permeation therethrough of one of cations and anions, and a suitably selected ion exchanger can meet this requirement. According to this embodiment, an ion exchanger having the same ion-exchange group as the ion exchangers 266, 268 to be regenerated, i.e. a cation exchanger, is employed as the regeneration member 270, so that ions from the ion exchangers 266, 268 can be taken in the regeneration member 270.

Processing of a substrate (electrolytic processing of the substrate and regeneration of the ion exchangers) by the electrolytic processing apparatus 30*c* will now be described.

First, a substrate W is attracted and held by the substrate holder 234, and the substrate holder 234 is moved to a predetermined position above the processing table 236. Next, the substrate holder 234 is lowered to bring the substrate W, held by the substrate holder 234, into contact with the surfaces of the contact members 256, 258 covering the surfaces of the processing electrodes 252 and the feeding electrodes 254 mounted on the upper surface of the processing table 236, i.e. the surfaces of the ion exchangers 266. The regeneration section 264, in a case where it is designed to be retreatable and is in a retreat position, is moved to a predetermined position above the processing table 236, and is then lowered to bring the lower surface of the regeneration member 270 of the regeneration section 264 into contact with the surfaces of the contact members 256, 258 covering the front surfaces of the processing electrodes 252 and the feeding electrodes 254 mounted on the upper surface of the processing table 236, i.e. the surfaces of the ion exchangers 266, at a predetermined pressure.

A given voltage is applied from the processing power source 262 between the processing electrodes 252 and the feeding electrodes 254 while a given voltage is applied from the regeneration power source 273 between the processing electrodes 252, the feeding electrodes 254 and the regeneration electrode 272. At the same time, the substrate holder 234 and the processing table 236 are rotated (about it own axis, respectively). At this time, the coordinates of the processing table 236 are measured with, for example, a position sensor provided above the processing table 236 to detect the position of the processing table 236. It is also possible to detect the position of the processing table 236 with an encoder mounted to the hollow motor 248 for rotating the processing table 236, or with a light source mounted to the processing table 236 and a light-sensitive sensor mounted to a fixed base.

Based on the detected position of the processing table 236, with respect to the processing electrodes 252 and the feeding electrodes 254, whose front surfaces (upper surfaces) are covered with the contact members 256, 258 which come into contact with the substrate W held by the substrate holder 234, the processing electrodes 252 are connected to the cathode of the processing power source 262 while the feeding electrodes 254 are connected to the anode of the processing power source 262, as shown in FIG. 14. On the other hand, with respect to the processing electrodes 252 and the feeding electrodes 254, whose front surfaces (upper surfaces) are covered with the contact members 256, 258 which come into contact with the front surface (lower surface) of the regeneration member 270 of the regeneration section 264, the processing electrodes 252 and the feeding electrodes 254 are connected to the anode of the regeneration power source 273 while the regeneration electrode 272 is connected to the cathode of the regeneration power source 273, as shown in FIG. 15.

At the same time, a processing liquid, such as pure water, preferably ultrapure water, is supplied through the pure water supply pipe 250 to between the substrate W held by the substrate holder 234 and the contact members 256, 258, and between the regeneration member 270 of the regeneration section 264 and the contact members 256, 258.

In the area of the processing table 236 covered with the substrate W held by the substrate holder 234, the electrode reactions of the processing electrodes 252 and the feeding electrodes 254 and the migration of ions in the ion exchangers 266, 268 are caused by the above operation to effect electrolytic processing of e.g. the copper film 6 shown in FIG. 1B formed on the substrate W. At the same time, in the area of the processing table 236 covered with the regeneration section 264, through the ion-exchange reaction with the ion exchangers 266, 268, covering the surfaces of the processing electrodes 252 and the feeding electrodes 254, as a solid electrolyte, impurity ions such as copper ions in the ion exchangers 266, 268 are moved toward the regeneration member 270 of the regeneration section 264 and taken into the regeneration member 270. Regeneration of the ion exchangers 266, 268, constituting the contact members 256, 258 covering the surfaces of the processing electrodes 252 and the feeding electrodes 254 which have been used for processing, is thus effected.

In the case of using cation exchangers as the ion exchangers 266, 268, cations taken in the ion exchangers 266, 268 are moved toward the regeneration member 270 and taken into the regeneration member 270, whereby the ion exchangers 266, 268 are regenerated. In the case of using anion exchangers as the ion exchangers 266, 268, anions taken into the ion exchangers 266, 268 are taken into the regeneration member 270, whereby the ion exchangers 266, 268 are regenerated.

By allowing a processing liquid, such as pure water or ultrapure water, to flow in the ion exchangers 266, 268, electrolytic processing can be effected efficiently.

As described above, the use as the regeneration 270 an ion exchanger having the same ion-exchange group as the ion exchangers 266, 268 to be regenerated, impurity ions in the ion exchangers 266, 268 can migrate through the regeneration member (ion exchanger) 270, without inhibition of their permeation through the regeneration member 270, thereby avoiding an increase in the power consumption.

After the completion of electrolytic processing, the processing electrodes 252 and the feeding electrodes 254 are disconnected from the processing power source 262, and the processing electrodes 252, the feeding electrodes 254 and the regeneration electrode 272 are disconnected from the regeneration power source 273. Further, the rotation of the substrate holder 234 and the rotation of the processing table 236 are stopped. Thereafter, the substrate holder 234 is raised and then moved horizontally in the lateral direction to send the substrate W after electrolytic processing to the next process step. On the other hand, the regeneration section 264 is raised and, according to necessity, moved to the retreat position.

According to this embodiment, pure water, preferably ultrapure water, is supplied between the substrate W and the ion exchangers 266, 268 acting as the contact members 256, 258, and between the regeneration member 270 of the regeneration section 264 and the ion exchangers 266, 268. As in the above-described embodiments, however, it is also possible to use an electrolytic solution, etc. instead of pure water or ultrapure water.

Figure 16A:
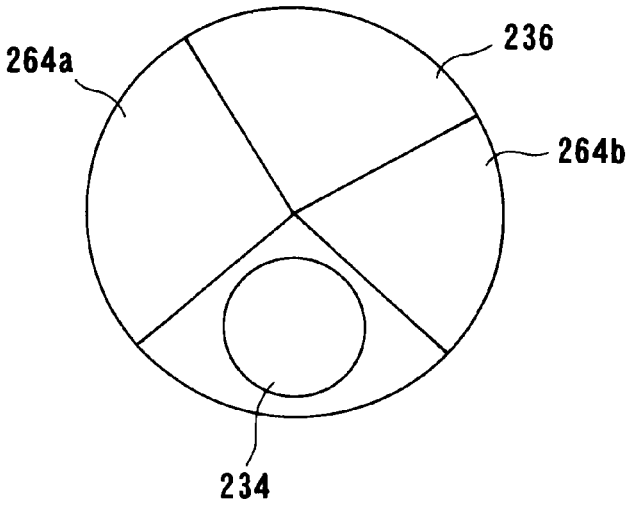
FIGS. 16A through 16C are diagrams showing variations of the regeneration section in terms of shape and arrangement.
Figure 16B:
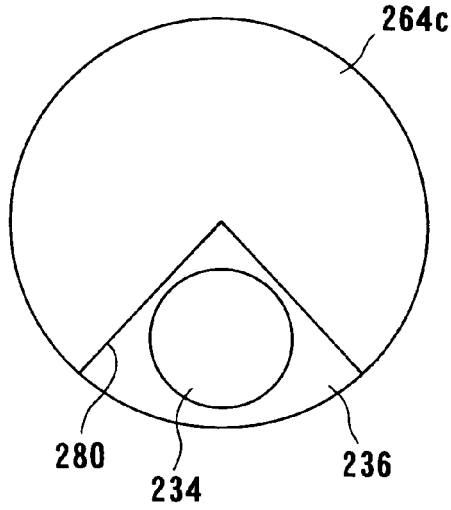
Figure 16C:
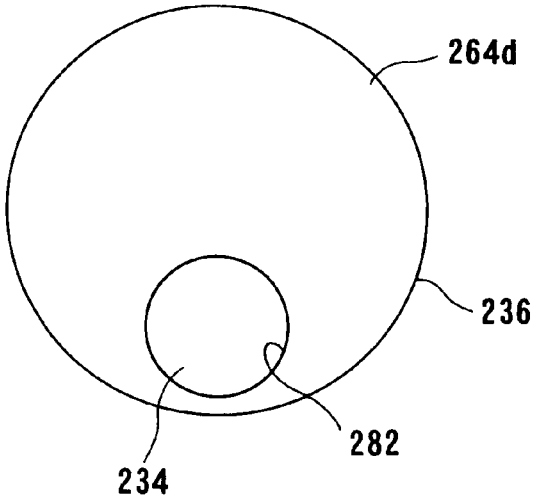

FIGS. 16A through 16C show variations of the regeneration section 264 in terms of shape and arrangement. In particular, FIG. 16A shows a variation in which a pair of fan-shaped regeneration sections 264*a*, 264*b* is disposed above the processing table 236 on either side of the substrate holder 234 along the circumferential direction of the processing table 236. This variation makes it possible to regenerate the contact members 256 covering the surfaces of the processing electrodes 252 and the contact members 258 covering the surfaces of the feeding electrodes 254 immediately before and immediately after their use for processing of a substrate W held by the substrate holder 234.

FIG. 16B shows a variation in which a circular regeneration section 264*c*, having substantially the same size as the processing table 236 and having a fan-shaped cut-off portion 280, is provided, and the regeneration section 264*c*, with the substrate holder 234 positioned in the cut-off portion 280, is disposed concentrically with the processing table 236. FIG. 16C shows a variation in which a circular regeneration section 264*d*, having substantially the same size as the processing table 236 and having at a predetermined position a through-hole 282 conforming to the outer shape of the substrate holder 234, is provided, and the regeneration section 264*d*, with the substrate holder 234 positioned in the through hole 282, is disposed concentrically with the processing table 236. The variations shown in FIGS. 16B and 16C can provide regeneration sections 264*c*, 264*d* having wide areas.

Figure 17:
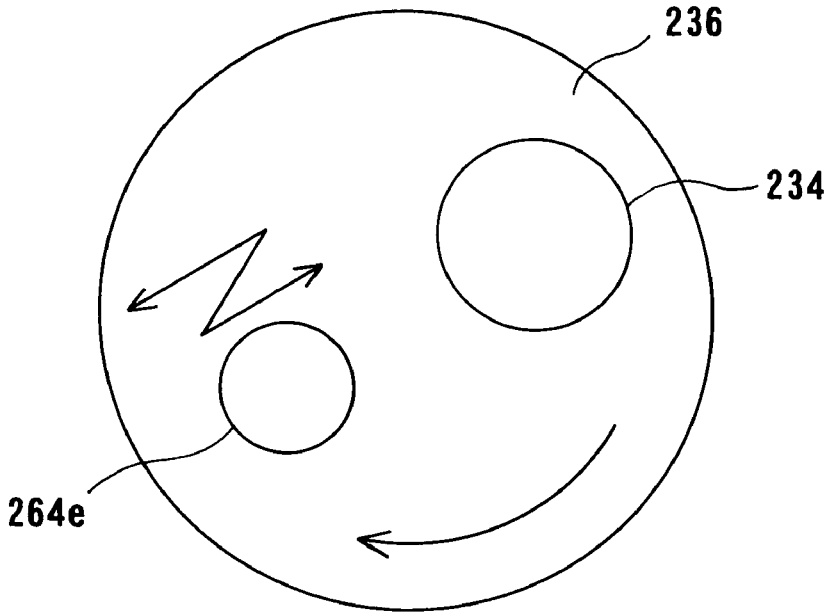
FIG. 17 is a diagram showing yet another variation of the regeneration section.

According to the foregoing embodiments, upon regeneration of the contact members 256 covering the surfaces of the processing electrodes 252 and the contact members 258 covering the surfaces of the feeding electrodes 254, the position of the regeneration section 264 relative to the substrate holder 234 is fixed. As shown in FIG. 17, it is also possible, for example, to use a regeneration section 264*e* having a smaller diameter than that of the substrate holder 234 and design the regeneration section 264*e* to be movable in the radial direction of the processing table 236. Upon regeneration of the contact members 256 covering the surfaces of the processing electrodes 252, and the contact members 258 covering the surfaces of the feeding electrodes 254, the regeneration section 264*e* is moved in the radial direction of the processing table 236 while rotating the processing table 236. The use of the movable regeneration section 264*e* can increase the structural freedom of the regeneration member 270 (see FIG. 15) and, in addition, can focus regeneration on a particular portion of the contact members for which regeneration is especially needed. In this variation, regeneration of the contact members may be carried out either by connecting the regeneration section to the regeneration power source and applying a voltage between the regeneration section and the processing electrodes, or by bringing the regeneration section, as a dummy electrode, into contact with the contact members without connecting the regeneration section to the regeneration power source.

Figure 18:
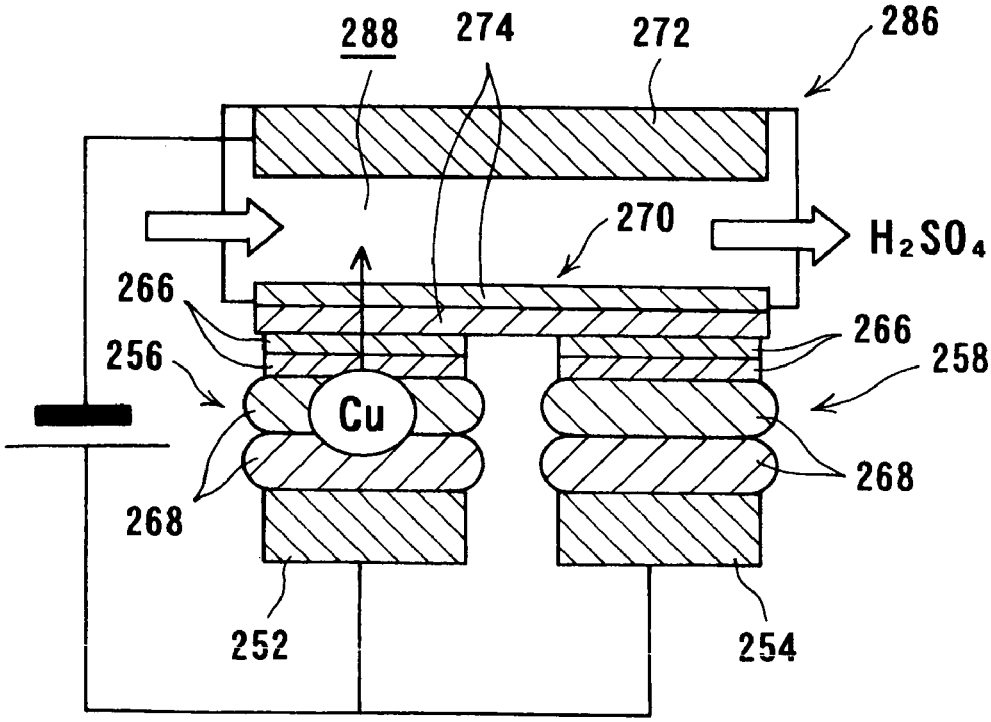
FIG. 18 is a diagram illustrating, on a larger scale, the relationship between the regeneration section, the processing electrode and the feeding electrode of an electrolytic processing apparatus according to yet another embodiment of the present invention.

FIG. 18 shows the main portion of the regeneration section 286 of an electrolytic processing apparatus according to yet another embodiment of the present invention. The regeneration section 286 differs from the regeneration section 264 of the preceding embodiment in that the regeneration member 270 is comprised only of the two-layer ion exchanger 274, for example, Nafion (trademark of DuPont) with a thickness of e.g. 0.2 mm, and a discharging liquid flow passage 288 is provided between the regeneration member 270 and the regeneration electrode 272, so that a discharging liquid introduced into the discharging liquid flow passage 288 flows in one direction along the discharging liquid flow passage 288 and is discharged out of the system.

According to this embodiment, processing of the substrate W and regeneration of the contact members 256, 258 are carried out while supplying a discharging liquid into the discharging liquid flow passage 288 and allowing the discharging liquid to flow in one direction along the discharging liquid flow passage 288, substantially in the same manner as the above-described embodiment. During regeneration, the regeneration member 270 of the two-layer ion exchanger 274 functions as a diaphragm. Impurity ions, etc., move toward the regeneration member (diaphragm) 270, pass through the regeneration member 270, and are introduced into the discharging liquid flow passage 288 and, by the flow of the discharging liquid flowing along the discharging liquid flow passage 288, are discharged out of the system, as with the above-described case. It is possible to additionally provide an ion exchanger in the discharging liquid flow passage 288.

As with the above-described embodiment, the discharging liquid may be appropriately selected depending upon the type of the impurity ion to be discharged. For example, when regenerating an ion exchanger which has been use for electrolytic polishing of copper, sulfuric acid with a concentration of 1 wt % or higher may be used.

Figure 19:
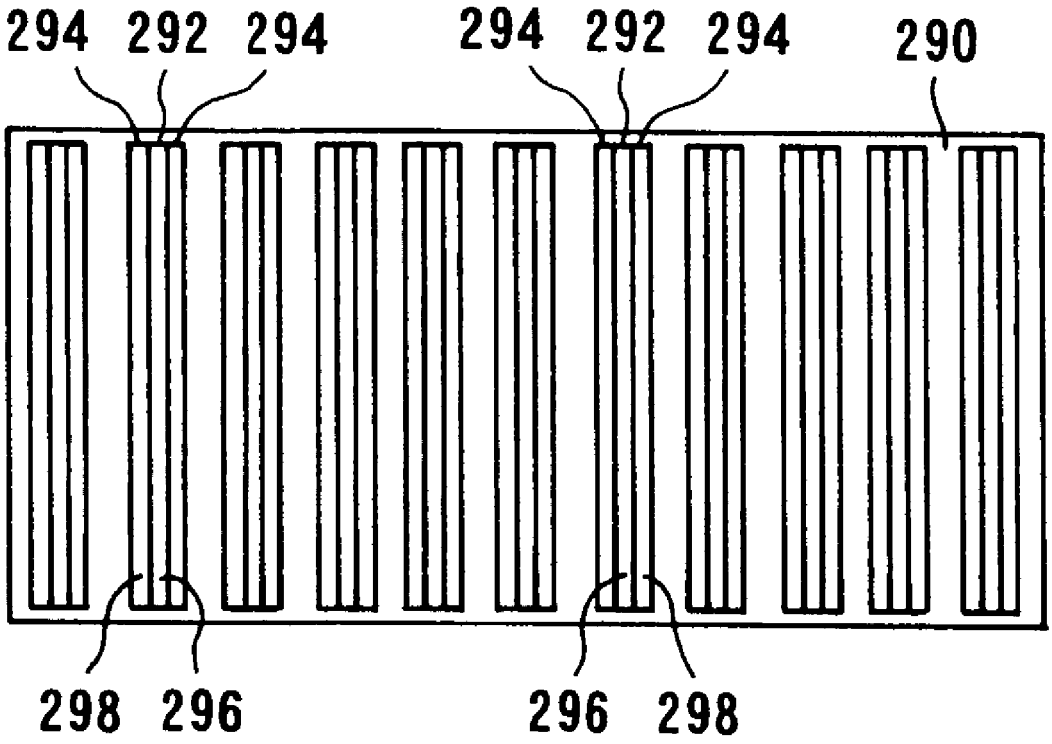
FIG. 19 is a plan view of the processing table of an electrolytic processing apparatus according to yet another embodiment of the present invention.
Figure 20A:
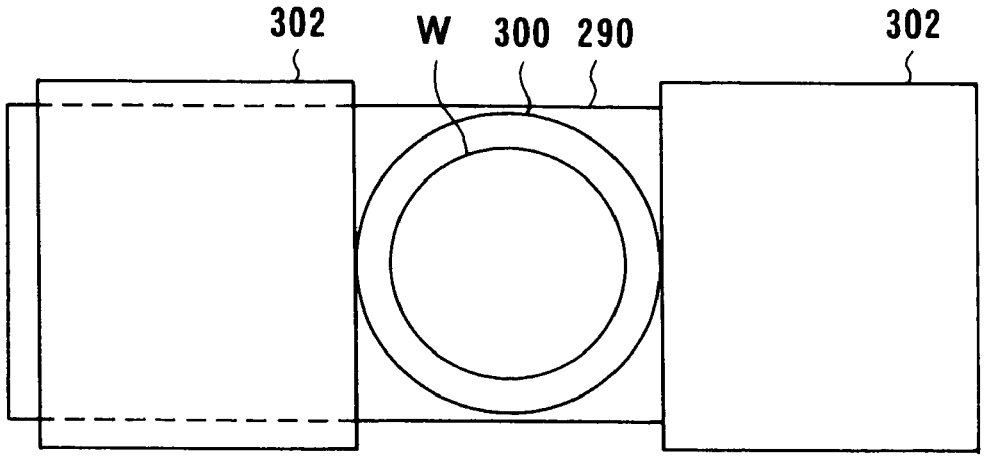
FIGS. 20A through 20C are schematic diagrams illustrating regeneration of an ion exchanger during processing of a substrate with the processing table shown in FIG. 19.
Figure 20B:
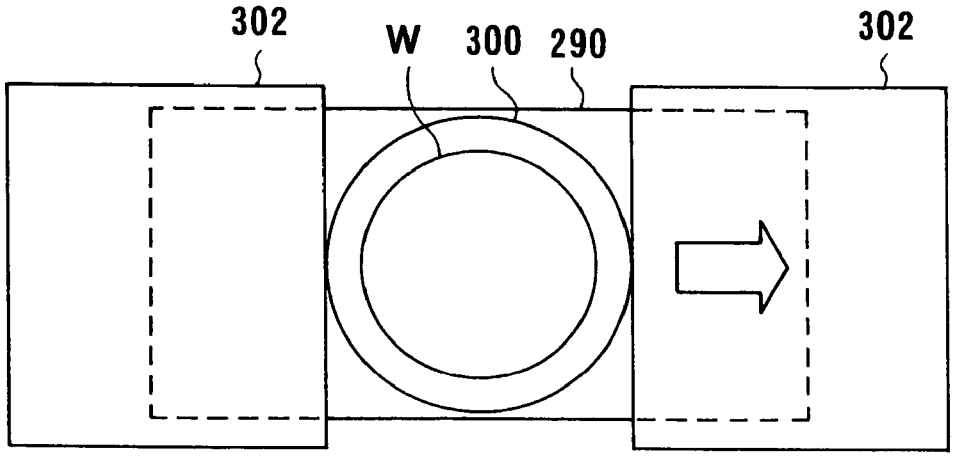
Figure 20C:
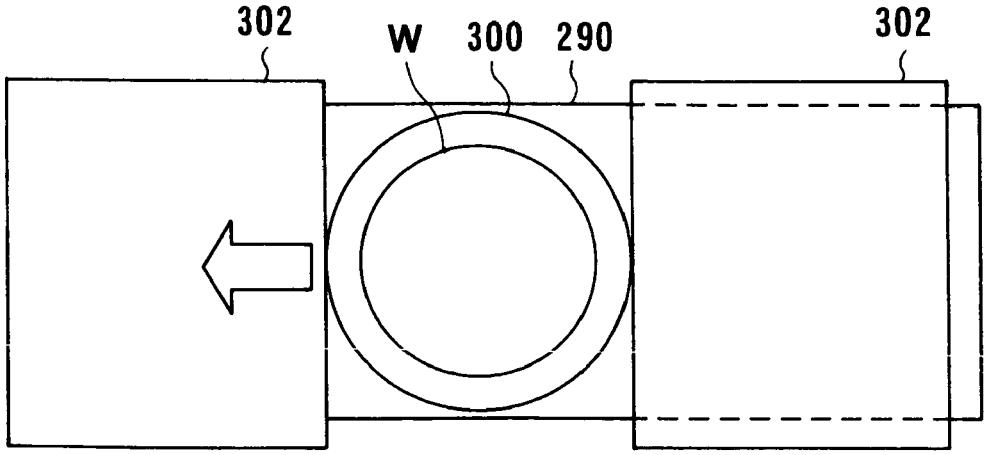

FIG. 19 is a plan view of the processing table 290 of an electrolytic processing apparatus according to yet another embodiment of the present invention, and FIGS. 20A through 20C are schematic diagrams illustrating regeneration of an ion exchanger during processing of a substrate with the processing table 290. As shown in FIG. 19, processing electrodes 292 extending linearly over approximately the full width of the processing table 290 are provided on the upper surface of the processing table 290 at a given pitch along the length direction of the processing table 290, and a pair of feeding electrodes 294 extending linearly over approximately the full width of the processing table 290 is disposed on either side of each processing electrode 292. As in the above-described embodiment, a contact member 296 comprised of the ion exchangers 266, 268 (see FIGS. 14 and 15) is provided on the upper surface (front surface) of each processing electrode 292, and a contact member 298 comprised of the ion exchangers 266, 268 is provided also on the upper surface (front surface) of each feeding electrode 294. The processing table 290 is reciprocatable in the length direction.

As shown in FIGS. 20A through 20C, a vertically-movable substrate holder 300 for detachably holding a substrate W with its front surface facing downwardly is disposed above the processing table 290. A pair of rectangular, vertically-movable regeneration sections 302, each either including the regeneration member 270 and the regeneration electrode 272 (see FIG. 15), or including the regeneration member 270, the regeneration electrode 272 and the discharging liquid flow passage 288 (see FIG. 18), as in the preceding embodiments, is disposed on either side of the substrate holder 300 along the movement direction of the processing table 290. Though not shown diagrammatically, a sensor for detecting the position of the processing table 290 is provided, for example, above the processing table 290.

According to this embodiment, while reciprocating the processing table 290 in the length direction and rotating the substrate holder 300, a substrate W, held by the substrate holder 300, and the lower surface of the regeneration member of each regeneration section 302 are brought into contact with the contact members 296 covering the front surfaces of the processing surfaces 292 and with the contact members 298 covering the front surfaces of the feeding electrodes 294, as with the above-described embodiment. Based on the detected position of the processing table 290, with respect to the processing electrodes 292 and the feeding electrodes 294, whose front surfaces (upper surfaces) are covered with the contact members 296, 298 which come into contact with the substrate W held by the substrate holder 300, the processing electrodes 292 are connected to the cathode of a processing power source while the feeding electrodes 294 are connected to the anode of the processing power source. On the other hand, with respect to the processing electrodes 292 and the feeding electrodes 294, whose front surfaces (upper surfaces) are covered with the contact members 296, 298 which come into contact with the front surface (lower surface) of the regeneration member of the regeneration section 302, the processing electrodes 292 and the feeding electrodes 294 are connected to the anode of a regeneration power source while the regeneration electrode of the regeneration section 302 is connected to the cathode of the regeneration power source.

At the same time, a processing liquid, such as pure water, preferably ultrapure water, is supplied between the substrate W held by the substrate holder 300 and the contact members 296, 298, and between the regeneration member of the regeneration section 302 and the contact members 296, 298.

In the area of the processing table 290 covered with the substrate W held by the substrate holder 300, electrolytic processing of the substrate W is carried out by the processing electrodes 292 and the feeding electrodes 294. At the same time, in the area of the processing table 290 covered with the regeneration sections 302, regeneration of e.g. the ion exchangers 266, 268 (see FIGS. 14 and 15), constituting the contact members 296 covering the front surfaces of the processing electrodes 292 and the contact members 298 covering the front surfaces of the feeding electrodes 294, is carried out.

According to this embodiment, regeneration of the contact members 296, 298 is thus carried out by the regeneration sections 302 disposed on either side of the substrate holder 300 along the movement direction (length direction) of the processing table 290 while reciprocating the processing table 290 in the length direction. This makes it possible to process a substrate always with the contact members 296, 298 which have been regenerated. It is, of course, possible to dispose one regeneration section 302 on one side of the substrate holder 300 along the movement direction of the processing table 290. Further, though the processing table 290 is moved in this embodiment, it is also possible to fix the processing table 290, and move the substrate holder 300 and the regeneration sections 302 relative to the processing table 290 independently by their own moving mechanism.

Figure 21:
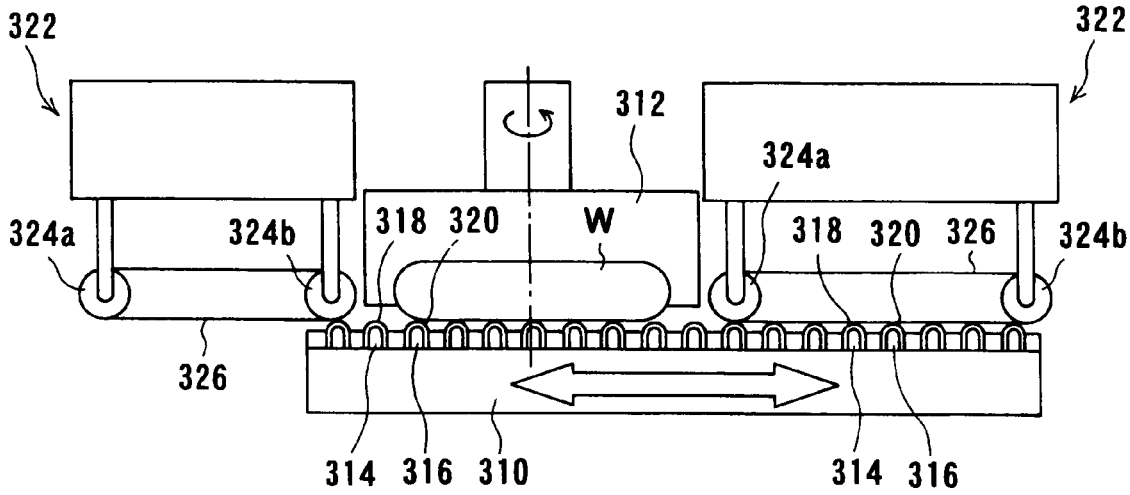
FIG. 21 is a vertical sectional view of an electrolytic processing apparatus according to yet another embodiment of the present invention.
Figure 22:
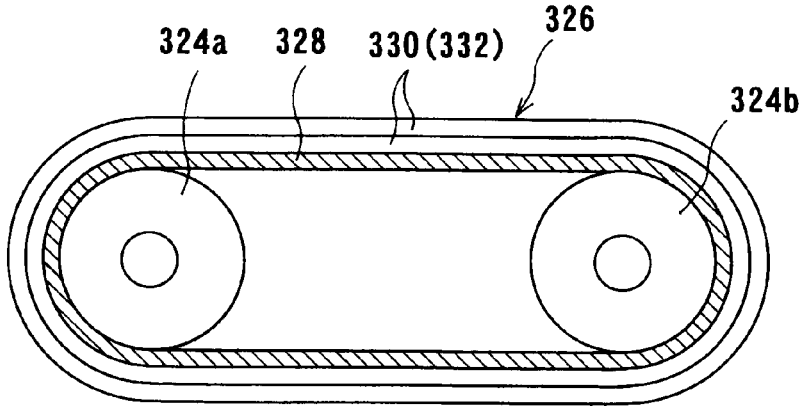
FIG. 22 is a vertical sectional view of a regeneration section used in the electrolytic processing apparatus shown in FIG. 21.

FIG. 21 is a vertical sectional view of an electrolytic processing apparatus according to yet another embodiment of the present invention, and FIG. 22 is a vertical sectional view of a regeneration section used in the electrolytic processing apparatus. As shown in FIG. 21, the electrolytic processing apparatus includes a processing table 310 which is reciprocatable in the length direction, and a rotatable, vertically-movable substrate holder 312, disposed above the processing table 310, for detachably holding a substrate W. Processing electrodes 314 and feeding electrodes 316, extending in the width direction of the processing table 310 over approximately the full width, are arranged alternately on the upper surface of the processing table 310 at a given pitch along the length direction of the processing table 310. The exposed surface of each processing electrode 314 is covered integrally with a contact member 318 composed of an ion exchanger, and the exposed surface of each feeding electrode 316 is likewise integrally covered with a contact member 320 composed of an ion exchanger.

Positioned above the processing table 310, a pair of vertically-movable regeneration sections 322 is disposed on either side of the substrate holder 312 along the movement direction of the processing table 310. Each regeneration section 322 includes a pair of rollers 324*a*, 324*b* and a belt 326 that extends between the rollers 324*a*, 324*b* and travels by the rotations of the rollers 324*a*, 324*b*. The belt 326 is comprised of a laminate of an inner electrode layer 328 as a regeneration electrode and an outer regeneration member 332 composed of a two-layer ion exchanger 330. At least one of the rollers 324*a*, 324*b* is made of, for example, platinum and is utilized also as an electrode so that it can feed electricity to the electrode layer (regeneration electrode) 328 so as to make the electrode layer 328 a cathode. Though not shown diagrammatically, a sensor for detecting the position of the processing table 310 is provided, for example, above the processing table 310.

According to this embodiment, while reciprocating the processing table 310 in the length direction and rotating the substrate holder 312, a substrate W, held by the substrate holder 312, and the belt 326 of each regeneration section 322 are brought into contact with the contact members 318 covering the processing electrodes 314 and with the contact members 320 covering the feeding electrodes 316, substantially in the same manner as the above-described embodiment. At the same time, the belt 326 of the regeneration section 322 is allowed to travel so that the relative speed between the belt 326 and the processing table 310 becomes zero. Based on the detected position of the processing table 310, with respect to the processing electrodes 314 and the feeding electrodes 316, which face the substrate W held by the substrate holder 312, the processing electrodes 314 are connected to the cathode of a processing power source while the feeding electrodes 316 are connected to the anode of the processing power source. On the other hand, with respect to the processing electrodes 314 and the feeding electrodes 316, which face the belt 326 of the regeneration section 322, the processing electrodes 314 and the feeding electrodes 316 are connected to the anode of a regeneration power source while the electrode layer (regeneration electrode) 328 of the regeneration section 322 is connected to the cathode of the regeneration power source.

At the same time, a processing liquid, such as pure water, preferably ultrapure water, is supplied between the substrate W held by the substrate holder 312 and the contact members 318, 320, and between the regeneration member 332 of the regeneration section 322 and the contact members 318, 320.

In the area of the processing table 310 covered with the substrate W held by the substrate holder 312, electrolytic processing of the substrate W is carried out by the processing electrodes 314 and the feeding electrodes 316. At the same time, in the area of the processing table 310 covered with the regeneration sections 322, regeneration of the contact members (ion exchanger) 318 covering the surfaces of the processing electrodes 314 and the contact members (ion exchanger) 320 covering the surfaces of the feeding electrodes 316, is carried out.

According to this embodiment, the belt 326 of the regeneration section 322 is allowed to travel so that the relative speed between the belt 326 and the processing table 310 becomes zero. This prevents the contact members 318 covering the processing electrodes 314 and the contact members 320 covering the feeding electrodes 316 from rubbing against the regeneration member 332 constituting the surface layer of the belt 326. Thus, the contact members 318, 320 and the regeneration member 332, which are composed of ion exchangers generally having poor wear resistance, can be prevented from wearing by rubbing together, whereby their lives can be extended. Further, it becomes possible to bring a new portion of the regeneration member 332 into contact with the contact members 318, 320, thereby enhancing the regeneration ability.

According to this embodiment, one of the pair of rollers 324*a*, 324*b* is a driving roller, and the belt 326 travels in one direction by the actuation of the driving roller. It is also possible to support the pair of rollers 324*a*, 324*b* rotatably, and allows the belt 326 to travel by the frictional force generated between the belt 326 and the contact members 318, 320 in contact with the belt 326 when the processing table 310 moves in the length direction. This holds also for the following embodiments.

Figure 23:
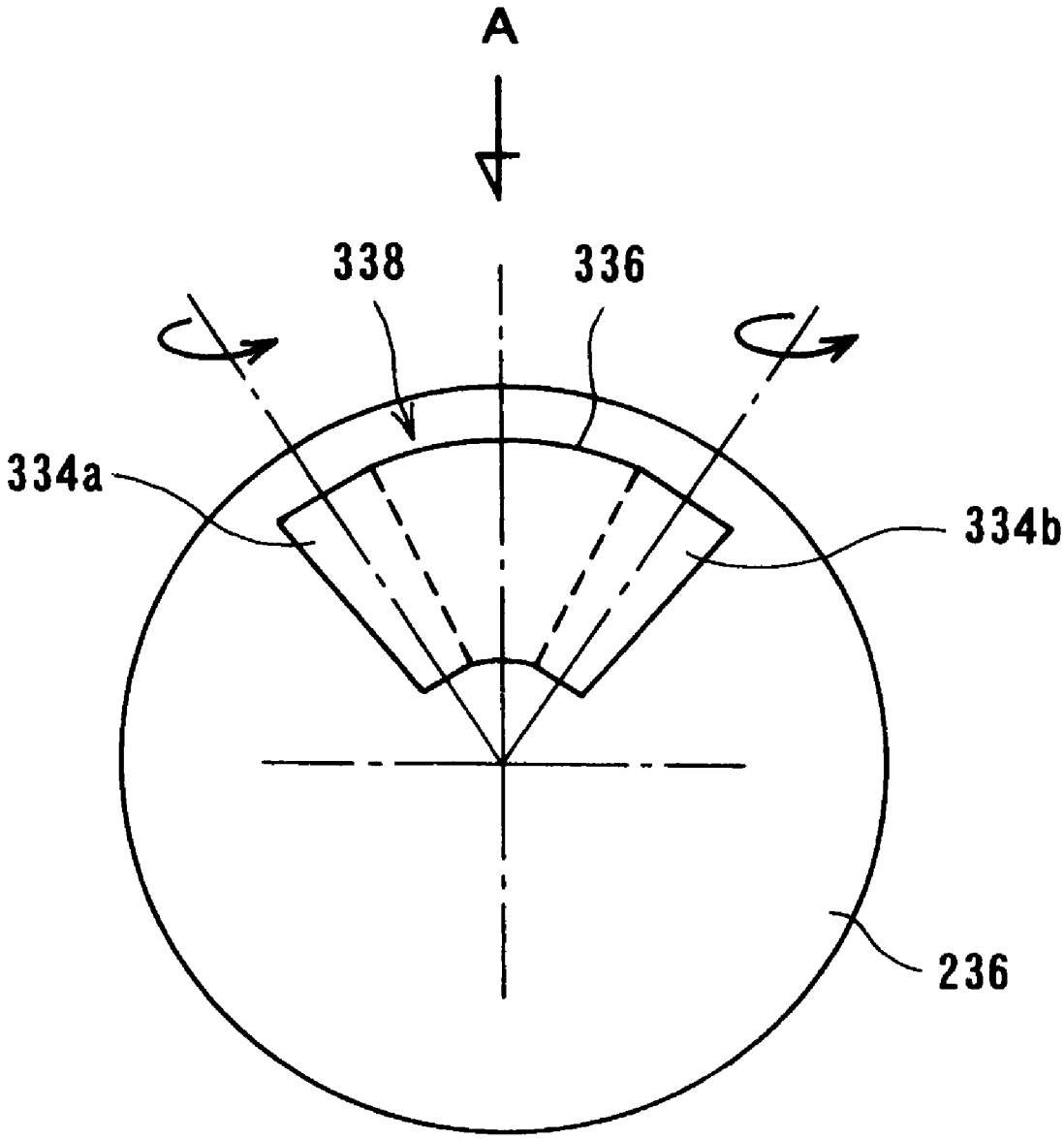
FIG. 23 is a plan view of an electrolytic processing apparatus according to yet another embodiment of the present invention.
Figure 24:
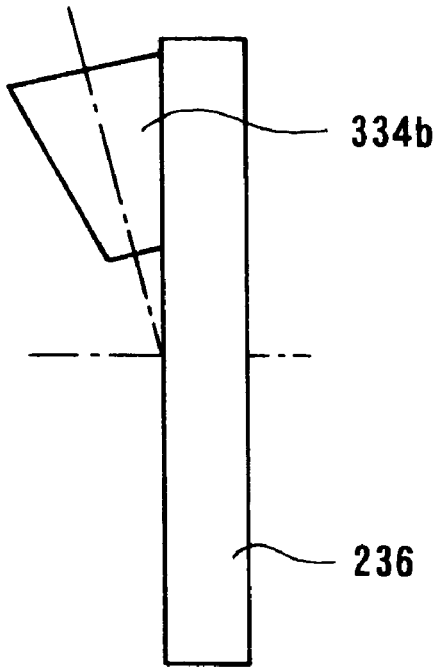
FIG. 24 is a right side view of the electrolytic processing apparatus of FIG. 23.
Figure 25:
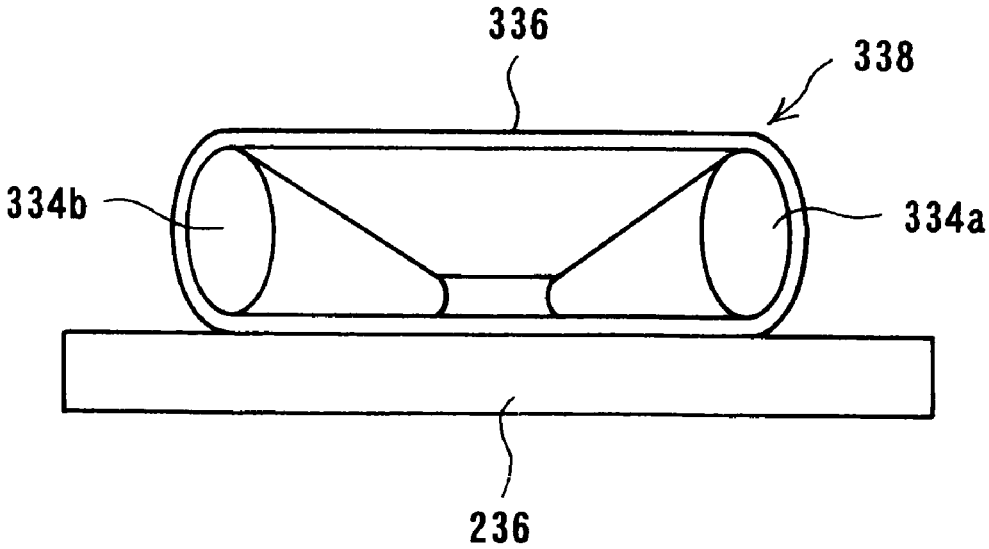
FIG. 25 shows the electrolytic processing apparatus of FIG. 23 as viewed from arrow A.

FIG. 23 is a plan view of an electrolytic processing apparatus according to yet another embodiment of the present invention, FIG. 24 is a right side view of the electrolytic processing apparatus, and FIG. 25 shows the electrolytic processing apparatus as viewed from arrow A shown in FIG. 23. The electrolytic processing apparatus of this embodiment includes a circular processing table 236, for example the processing table shown in FIG. 12, and a regeneration section 338 disposed above the processing table 236. The regeneration section 338 includes a pair of conical rollers 334*a*, 334*b* and a belt 336 which extends between the rollers 334*a*, 334*b* and travels in one direction. Similarly to the belt 326 shown in FIG. 22, the belt 336 is comprised of an electrode layer (regeneration electrode) to which electricity is fed from at least one of the rollers 334*a*, 334*b*, and a regeneration member composed of an ion exchanger.

According to this embodiment, the belt 336, which makes contact with the upper surface of the processing table 236 while traveling on the lower side, is allowed to travel in synchronization with the rotation of the processing table 236 so that the relative speed between the surface of the processing table 236 and the belt 336 in contact with the processing table 236 becomes zero. This, as with the embodiment shown in FIGS. 21 and 22, can prevent the contact members and the regeneration member, which are composed of ion exchangers generally having poor wear resistance, from wearing by rubbing.

Figure 26:
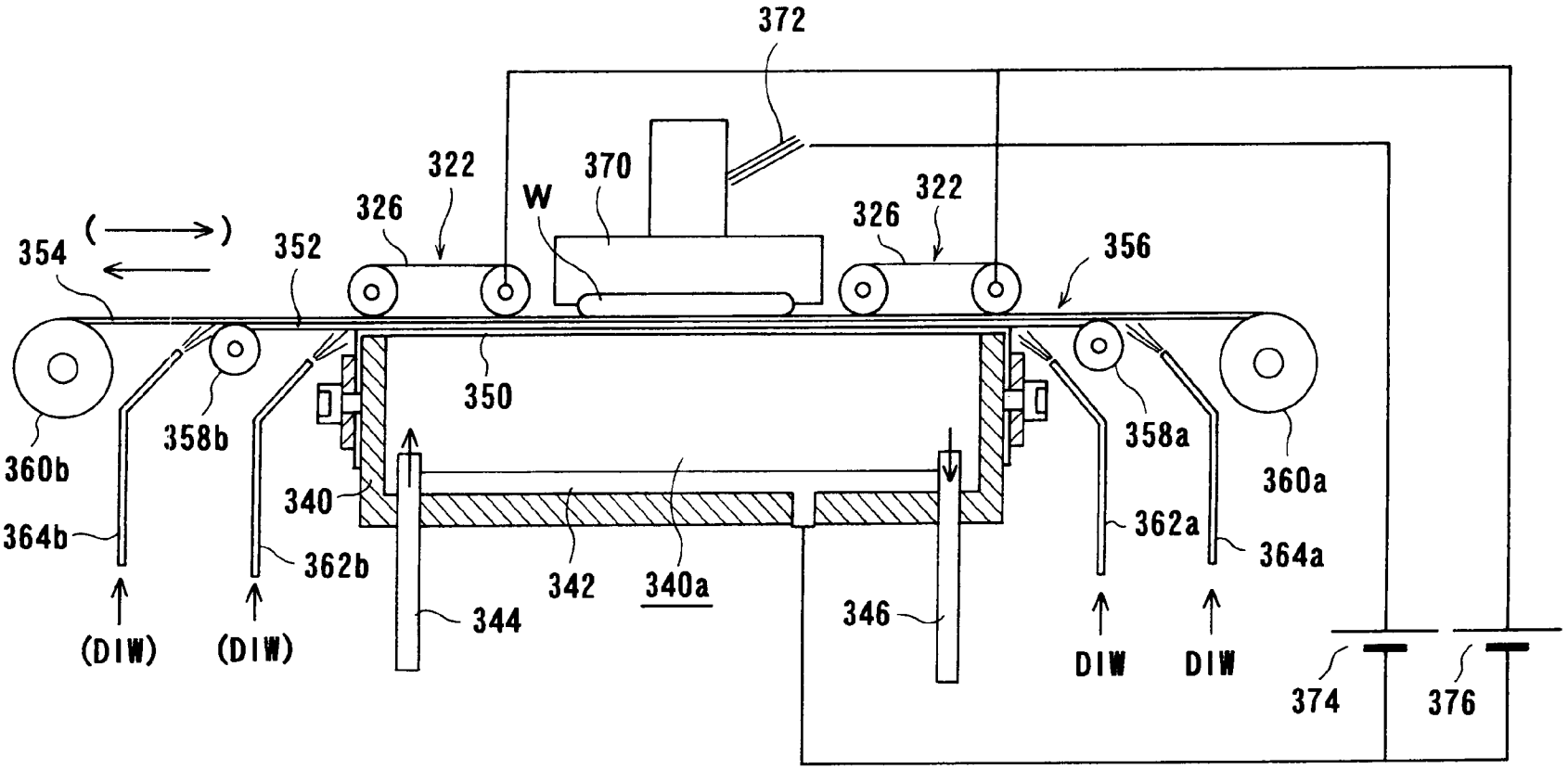
FIG. 26 is a vertical sectional view of an electrolytic processing apparatus according to yet another embodiment of the present invention.

FIG. 26 is a vertical sectional view of an electrolytic processing apparatus according to yet another embodiment of the present invention. As shown in FIG. 26, the electrolytic processing apparatus includes a processing table 340 having an upwardly-open discharging liquid flow passage 340*a* and a tabular processing electrode 342 disposed at the bottom of the discharging liquid flow passage 340*a*. The discharging liquid flow passage 340*a* of the processing table 340 is connected to a discharging liquid supply pipe 344 and to a discharging liquid discharge pipe 346.

A contact member 356 according to this embodiment is comprised of a first-layer ion exchanger (diaphragm membrane) 350, for example Nafion (trademark of DuPont) with a thickness of 0.2 mm, which has no liquid-permeability and functions as a diaphragm, a second-layer ion exchanger (intermediate membrane) 352 having a large ion-exchange capacity, for example a C-membrane (non-woven fabric ion exchanger) with a thickness of 1 mm, and a third-layer ion exchanger (surface membrane) 354 having a surface smoothness, for example Nafion (trademark of DuPont) with a thickness of 0.2 mm.

The first-layer ion exchanger (diaphragm membrane) 350 is fixed at such a position that it covers the entire surface of the processing table 340 and a discharging liquid, which has flowed into the discharging liquid flow passage 340*a*, comes into contact with the back surface of the ion exchanger 350. The second-layer ion exchanger (intermediate membrane) 352, on the other hand, extends between a pair of rollers 358*a*, 358*b* disposed on both sides of the processing table 340. By the rotations of the rollers 358*a*, 358*b*, the second-layer ion exchanger 352 travels in one direction while its back surface keeps in contact with the front surface of the first-layer ion exchanger 350, and is taken up. After the second-layer ion exchanger 354 is all taken up, it travels in the reverse direction. Similarly, the third-layer ion exchanger (surface membrane) 354 extends between a pair of rollers 360*a*, 360*b* disposed on both sides of the processing table 340 and outside the pair of rollers 358*a*, 358*b*, and, by the rotations of the rollers 360*a*, 360*b*, travels in synchronization and almost integrally with the second-layer ion exchanger 352 in the same direction.

Further, positioned on both sides of the processing table 340, there are disposed a pair of pure water supply nozzles 362*a*, 362*b* for supplying pure water, preferably ultrapure water, etc. between the first-layer ion exchanger 350 and the second-layer ion exchanger 352, and a pair of pure water supply nozzles 364*a*, 364*b* for supplying pure water, preferably ultrapure water, etc. between the second-layer ion exchanger 352 and the third-layer ion exchanger 354, respectively. Pure water, etc. is supplied from the pure water supply nozzles 362*a*, 364*a* or 362*b*, 364*b*, positioned on the upstream side in the traveling direction of the ion exchangers 352, 354, to between the first-layer ion exchanger 350 and the second-layer ion exchanger 352, and between the second-layer ion exchanger 352 and the third-layer ion exchanger 354.

A vertically-movable substrate holder 370 for detachably holding a substrate W with its front surface facing downwardly is disposed above the processing table 340. The substrate holder 370 is provided with a brush electrode 372 as a feeding electrode which, when the substrate W is held by the substrate holder 370, feeds electricity to, for example, the copper film 6 shown in FIG. 1B formed on the front surface (processing surface) of the substrate W. Further, positioned above the processing table 340, a pair of vertically-movable regeneration sections 322, each having the same construction as the above-described one shown in FIG. 22, is disposed on either side of the substrate holder 370 along the traveling direction of the ion exchangers 352, 354.

According to this embodiment, the processing electrode 342 is connected to the cathode of a processing power source 374 and the brush electrode 372 is connected to the anode of the processing power source 374, and a given voltage is applied between the electrodes to effect electrolytic processing of the front surface of the substrate W held by the substrate holder 370. Further, the processing electrode 342 is connected to the cathode of a regeneration power source 376 and the electrode layer 328 (see FIG. 22) of the regeneration section 322 is connected, via at least one of the rollers 324*a*, 324*b*, to the anode of the regeneration power source 376, and a given voltage is applied between them to effect regeneration of the ion exchangers 350, 352, 354 constituting the contact member 356.

During the processing and regeneration, pure water or the like is supplied from the pure water supply nozzles 362*a*, 364*a* or 362*b*, 364*b*, positioned on the upstream side in the traveling direction of the ion exchangers 352, 354, to between the first-layer ion exchanger 350 and the second-layer ion exchanger 352, and between the second-layer ion exchanger 352 and the third-layer ion exchanger 354 while the second-layer ion exchanger (intermediate membrane) 352 and the third-layer ion exchanger (surface membrane) 354, both constituting the contact member 356, are allowed to travel in synchronization and in the same direction by the rollers 358*a*, 358 band the rollers 360*a*, 360*b*, respectively. At the same time, the belt 326 of the regeneration section 322 is allowed to travel so that the relative speed with the third-layer ion exchanger 354 becomes zero. Further, a discharging liquid, for example, sulfuric acid with a concentration of 1 wt % or higher, is supplied into the discharging liquid flow passage 340*a* of the processing table 340 so as to keep the discharging liquid flow passage 340*a* filled with the discharging liquid, and the discharging liquid is allowed to flow in one direction in the discharging liquid flow passage 340*a* and be discharged out of the system.

With respect to the substrate W held by the substrate holder 370, the surface (processing surface) of the substrate becomes an anode via the brush electrode 372, and electrolytic processing of the surface is effected by the processing electrode 342, positioned in the discharging liquid flow passage 340*a* and immersed in the discharging liquid, when a voltage is applied between it and the processing surface of the substrate. With respect to the regeneration section 322, on the other hand, the electrode layer 328 (see FIG. 22) becomes an anode. Accordingly, when a voltage is applied between the electrode layer 328 and the processing electrode 342, the system operates as if electrolytically processing the electrode layer 328 with the processing electrode 342. Thus, impurity ions such as copper ions, which have been taken mainly in the second-layer ion exchanger 352 and the third-layer ion exchanger 354, both constituting the contact member 356, are moved away from the electrode layer 328 and introduced into the discharging liquid flow passage 340*a* provided in the processing table 340, and are discharged out of the system with the discharging liquid flowing in one direction along the discharging liquid flow passage 340*a*. The ion exchangers 352, 354 are thus mainly regenerated.

According to this embodiment, when a thin ion-exchange membrane (film) having a smooth surface, for example, is employed as the ion exchanger 354 which is positioned in the surface (upper surface) of the contact member 356 having the multi-layer structure of ion exchangers 350, 352, 354 and which makes contact with a substrate, the mounting of the ion-exchange membrane (surface membrane of contact member) 354 can be performed with ease.

Further, during the regeneration of the ion exchanger 354, the relative speed between the ion exchanger 354 and the belt 326 of the regeneration section 322 is made zero. This can prevent the ion exchanger 354, especially in a thin film form, from wearing by rubbing. Since an ion exchanger having a large ion-exchange capacity is used as the second-layer ion exchanger (intermediate membrane) 352, most of the processing products can be taken in the ion exchanger 352. Further, while the ion exchanger 352 is traveling it can be used for electrolytic processing and, at the same time, regenerated. In addition, by making the relative speed between the second-layer ion exchanger (intermediate membrane) 352 and the third-layer ion exchanger (surface membrane) 354 zero, the ion exchangers 352, 354 can be prevented from wearing by rubbing.

Figure 27:
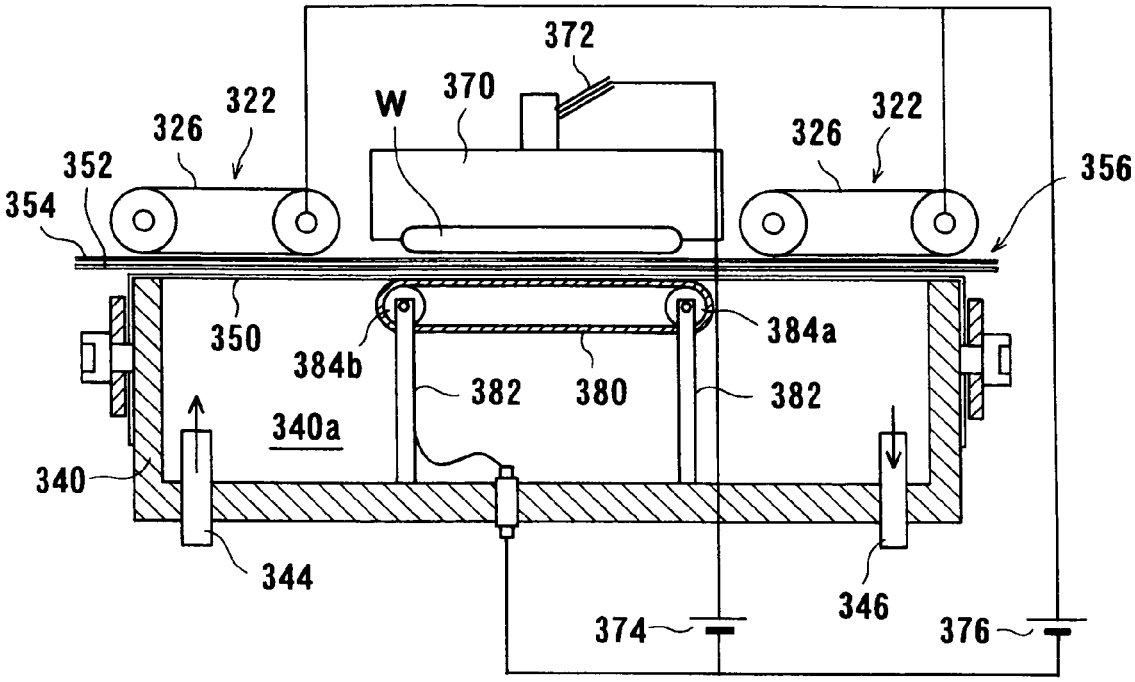
FIG. 27 is a vertical sectional view of an electrolytic processing apparatus according to yet another embodiment of the present invention.
Figure 28:
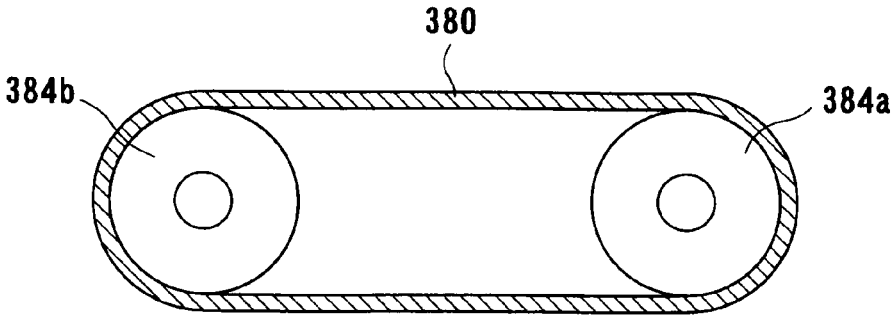
FIG. 28 is an enlarged view of a portion of FIG. 27.

FIG. 27 is a vertical sectional view of an electrolytic processing apparatus according to yet another embodiment of the present invention, and FIG. 28 is an enlarged view of the processing electrode of FIG. 27 comprised of a metal mesh belt. The embodiment shown in FIG. 27 differs from the preceding embodiment shown in FIG. 26 in that instead of the tabular processing electrode 342 used in the preceding embodiment, an endless metal mesh belt 380 made of a material which is unlikely to cause an electrolytic reaction, such as Pt-plated $TiO_2$, is employed as a processing electrode. A pair of support posts 382 is provided in the discharging liquid flow passage 340*a* of the processing table 340, and the metal mesh belt (processing electrode) 380 extends between a pair of rollers 384*a*, 384*b* rotatably supported at the upper ends of the support posts 382, so that by the rotations of the rollers 384*a*, 384*b*, the metal mesh belt 380 is allowed to travel in one direction. At least one of the rollers 384*a*, 384*b* is made of, for example, platinum and is utilized also as an electrode so that it can feed electricity to the metal mesh belt 380 so as to make the metal mesh belt 380 a cathode.

With this embodiment, it is possible to allow the metal mesh belt 380 to travel in synchronization with the second-layer ion exchanger 352 and the third-layer ion exchanger 354 in the same direction while keeping the metal mesh belt 380 close to or in contact with the back surface of the first-layer ion exchanger (diaphragm membrane) 350 constituting the contact member 356.

Figure 29:
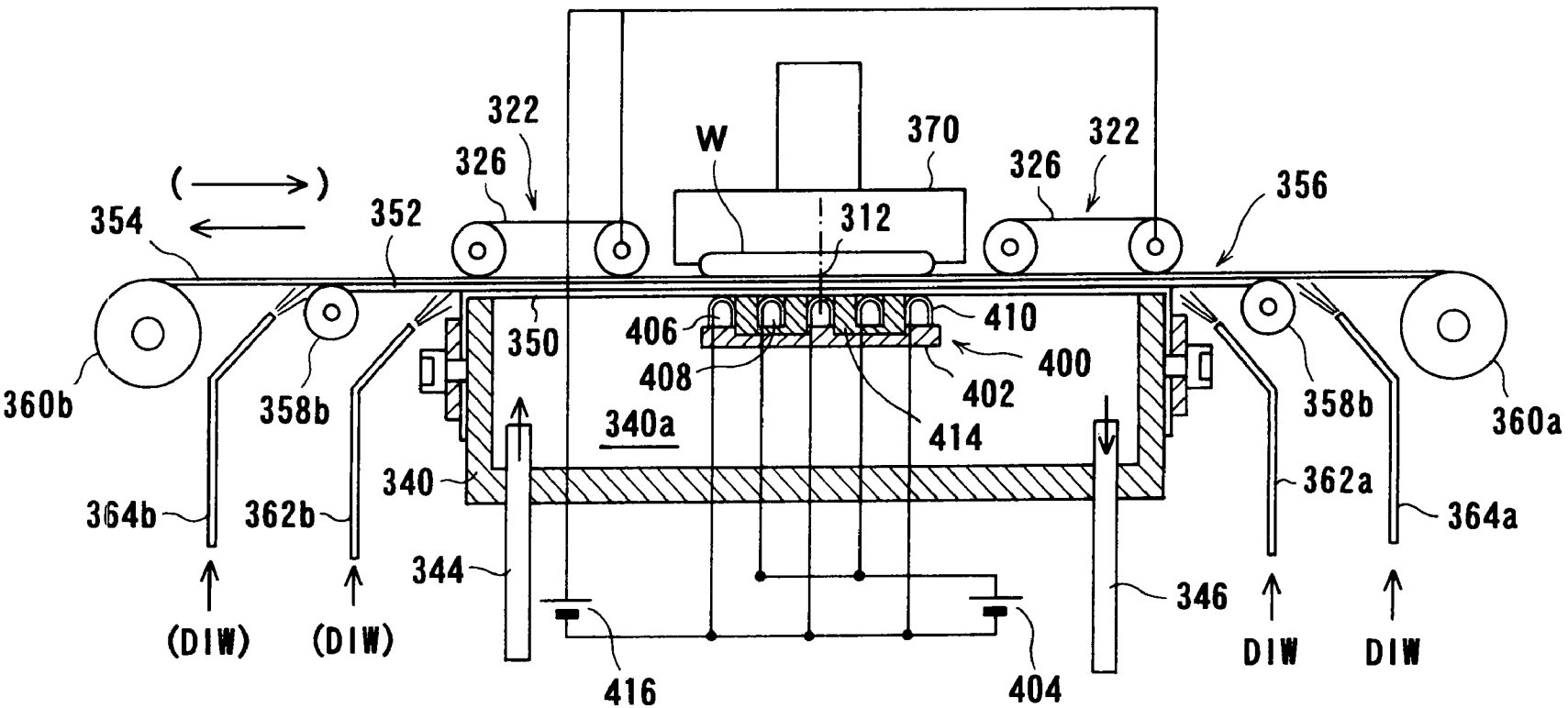
FIG. 29 is a vertical sectional view of an electrolytic processing apparatus according to yet. another embodiment of the present invention.

FIG. 29 is a vertical sectional view of an electrolytic processing apparatus according to yet another embodiment of the present invention. The electrolytic processing apparatus of this embodiment differs from the apparatus shown in FIG. 26 in that the substrate holder 370 is not provided with a brush electrode, and an electrode section 400 is disposed in the discharging liquid flow passage 340*a* of the processing table 340 such that it faces the substrate W held by the substrate holder 370 so that the contact member 356 is positioned between the substrate W held by the substrate holder 370 and the electrode section 400.

The electrode section 400 includes a rectangular tabular electrode base 402. Processing electrodes 406, connected to the cathode of a processing power source 404 and extending linearly in the width direction of the electrode base 402 over approximately the full width, and feeding electrodes 408, connected to the anode of the processing power source 404 and extending linearly in the width direction of the electrode base 402 over approximately the full width, are arranged alternately at a given pitch on the upper surface of the electrode base 402. The surface of each processing electrode 406 is integrally covered with a contact member 410 composed of an ion exchanger, and the surface of each feeding electrode 408 is likewise integrally covered with a contact member 412 composed of an ion exchanger. The contact members 410, 412 make contact with the back surface of the first-layer ion exchanger 352 of the contact member 356. Each processing electrode 406 and each feeding electrode 408 are electrically isolated from each other by a partition 414 interposed there between.

According to this embodiment, electrolytic processing of the processing surface of the substrate W is effected through the electrode reactions of the processing electrodes 406 connected to the cathode of the processing power source 404 and the feeding electrodes 408 connected to the anode of the processing power source 404 as well as the migration of ions in the ion exchangers 350, 352, 354, as with the above-described case. Further, regeneration of the ion exchangers 350, 352, 354 can be effected by connecting the processing electrodes 406 to the cathode of a regeneration power source 416 and connecting the electrode layer 328 (see FIG. 22) of the regeneration section 322 to the anode of the regeneration power source 416, and operating as if electrolytically processing the electrode layer 328 with the processing electrodes 406.

Figure 30:
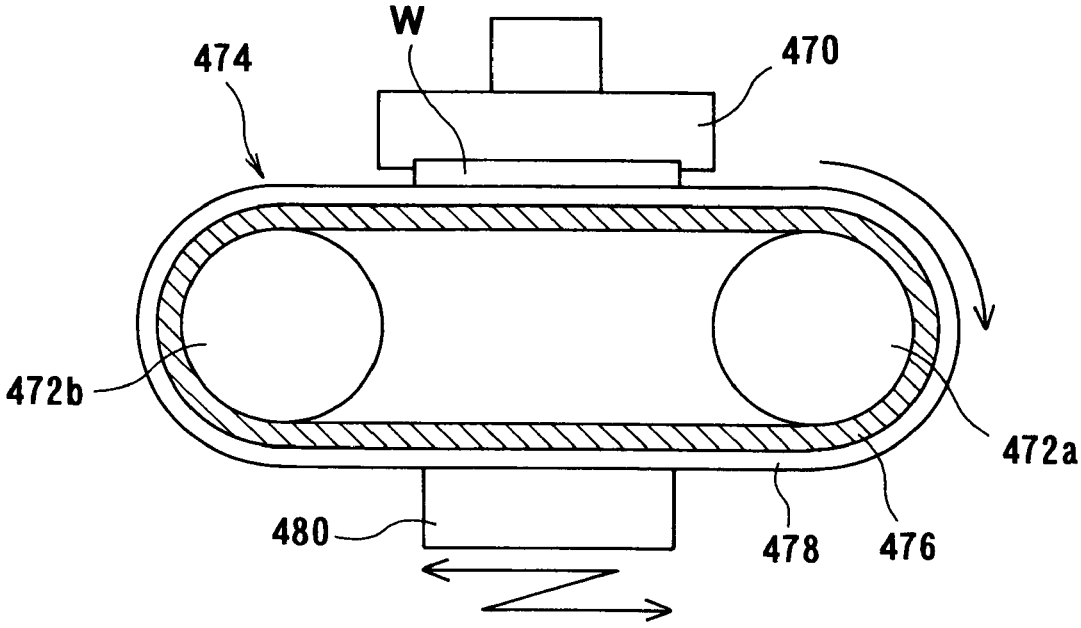
FIG. 30 is a vertical sectional view of an electrolytic processing apparatus according to yet another embodiment of the present invention.

FIG. 30 is a vertical sectional view of an electrolytic processing apparatus according to yet another embodiment of the present invention. The electrolytic processing apparatus includes a substrate holder 470 for detachably holding a substrate W, and an endless belt 474 which extends between a pair of rotating shafts 472*a*, 472*b* and travels in one direction by the rotation of one of the rotating shafts 472*a*, 472*b*. The belt 474 is comprised of an electrode belt 476 in which electrodes, which are to be connected alternately to the different poles of a not-shown power source to become processing electrodes or feeding electrodes, are embedded alternately at a given pitch, and a contact member 478, for example composed of an ion exchanger, superimposed on the electrode belt 476. Further, a regeneration section 480, which makes contact with the contact member 478 to regenerate it and which is movable in the traveling direction of the belt 474, is disposed on the opposite side of the belt 474 from the substrate holder 470.

According to this electrolytic processing apparatus, while allowing the belt 474 to travel in one direction, the substrate W held by the substrate holder 470 is brought into contact with the contact member 478 of the belt 474 and, at the same time, the electrodes provided at a given pitch in the belt 476 are connected alternately to the different poles of the power source, and pure water, preferably ultrapure water is supplied between the substrate W and the contact member 478, thereby carrying out processing of the surface of the substrate W. With respect to the regeneration section 480, on the other hand, a regeneration member (not shown) is allowed to travel in synchronization with the contact member 478 of the belt 474 in the same direction while keeping them in contact with each other. After allowing the contact member to travel a predetermined distance, it is returned to the original position. This operation is repeated to regenerate the contact member 478 composed of, for example, an ion exchanger. By thus allowing the regeneration section 480 to travel in the traveling direction of the belt 474, the contact member 478 can be regenerated while preventing the contact member 478 from wearing by rubbing.

It is also possible to allow the regeneration section 480 to travel in the direction perpendicular to the traveling direction of the belt 474. The regeneration section 480 according to this embodiment may either be connected to a regeneration power source, or utilized as a dummy electrode without connecting it to a regeneration power source in carrying out regeneration.

As described herein above, according to the present invention, regeneration of a contact member can be carried out by discharging, during processing, metal ions, which have been taken from a workpiece into the contact member during processing, from a discharge portion provided in an electrode section. This can prevent the regeneration from adversely affecting the throughput of the apparatus. Further, regeneration of the contact member may also be carried out by bringing a regeneration dummy electrode into contact with the contact member in the non-processing state, i.e. the state without taking-in of new metal ions, etc., and discharging metal ions in the contact member to the discharge portion. This makes it possible to regenerate the contact member with an enhanced regeneration rate of ion-exchange capacity.

Further, processing of a substrate on a processing table and regeneration of a contact member composed of an ion exchanger or the like can be carried out simultaneously. This can avoid the need to additionally provide a space for regeneration and can also enhance the throughput of the apparatus. Further, it is possible to not cause relative movement between a contact member and a regeneration section while they are moving. This can prevent the contact member, composed of an ion exchanger or the like generally having poor wear resistance, from wearing by rubbing, thereby extending the life of the contact member.

While the present invention has been described above in terms of certain preferred embodiments, the present invention is not limited to the above-described embodiments and many variations and modifications can be made within the technical concept of the invention.

What is claimed is:

1. An electrolytic processing apparatus comprising:

a holder for holding a workpiece;

an electrode section including (i) a processing electrode, (ii) a feeding electrode for feeding electricity to the workpiece, (iii) a contact member, positioned between the workpiece held by the holder and the processing electrode, which comes into contact with the workpiece during processing, and (iv) a discharge portion, formed between the processing electrode and the contact member, for discharging metal ions, which have been taken from the workpiece, from the contact member during the processing of the workpiece in the presence of a liquid; a power source for supplying a voltage between the processing electrode and the feeding electrode; and a regeneration dummy electrode for contacting the contact member, wherein the regeneration dummy electrode contacts the contact member while the power source supplies a voltage between the processing electrode and the feeding electrode in the same manner as in the processing of the workpiece, thereby regenerating the contact member.

2. The electrolytic processing apparatus according to claim 1, wherein the contact member includes an ion exchanger or a pad, or a combination thereof.

3. The electrolytic processing apparatus according to claim 1, wherein ultrapure water, pure water or a liquid having an electrolytic conductivity of not more than 500 μS/cm is supplied between the contact member and the regeneration dummy electrode.

4. The electrolytic processing apparatus according to claim 1, wherein the liquid is supplied between the contact member and the regeneration dummy electrode by (1) dropping onto a processing surface of the contact member, (2) a supply from a surface of the regeneration dummy electrode, (3) a supply from a supply port provided beside at least one of the processing electrode and the feeding electrode or (4) a supply from a supply port of at least one of the processing electrode and the feeding electrode, or a combination thereof.

5. The electrolytic processing apparatus according to claim 4, further comprising:

a mechanism for bringing the regeneration dummy electrode into contact with the contact member;

wherein the processing of the workpiece, held by the holder, by the electrode section and the regeneration of the contact member by the regeneration dummy electrode are carried out separately.

6. The electrolytic processing apparatus according to claim 4, wherein the regeneration of the contact member by the regeneration dummy electrode is carried out simultaneously with the processing of the workpiece, held by the holder, by the electrode section.

7. The electrolytic processing apparatus according to claim 4, wherein the regeneration dummy electrode is disposed such that it surrounds the workpiece held by the holder, and moves together with the holder.

8. The electrolytic processing apparatus according to claim 1, wherein at least that portion of the regeneration dummy electrode which comes into contact with the contact member is made of a chemically or electrochemically inactive conductive material.

9. The electrolytic processing apparatus according to claim 1, further comprising:

a mechanism for bringing the regeneration dummy electrode into contact with the contact member;

wherein the processing of the workpiece, held by the holder, by the electrode section and the regeneration of the contact member by the regeneration dummy electrode are carried out separately.

10. The electrolytic processing apparatus according to claim 9, wherein the regeneration dummy electrode is disposed such that it surrounds the workpiece held by the holder, and moves together with the holder.

11. The electrolytic processing apparatus according to claim 1, wherein the regeneration of the contact member by the regeneration dummy electrode is carried out simultaneously with the processing of the workpiece, held by the holder, by the electrode section.

12. The electrolytic processing apparatus according to claim 1, wherein the regeneration dummy electrode is disposed such that it surrounds the workpiece held by the holder, and moves together with the holder.

13. The electrolytic processing apparatus according to claim 1, further comprising:

a contact pressure control section for controlling a contact pressure of the regeneration dummy electrode on the contact member.

14. The electrolytic processing apparatus according to claim 13, wherein the contact pressure control section controls the contact pressure by its own weight or by an actuator or a pressure of a fluid introduced into a pressure chamber.

* * * * *